US006507724B2

(12) United States Patent
Tamura et al.

(10) Patent No.: US 6,507,724 B2
(45) Date of Patent: Jan. 14, 2003

(54) IMAGE FORMING APPARATUS WITH CLEANING MEMBER

(75) Inventors: Satoshi Tamura, Tokyo (JP); Yuji Bessho, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/818,628

(22) Filed: Mar. 28, 2001

(65) Prior Publication Data

US 2001/0028817 A1 Oct. 11, 2001

(30) Foreign Application Priority Data

Mar. 31, 2000 (JP) ..... 2000-099567

(51) Int. Cl.[7] ..... G03G 15/01; G03G 15/16; G03G 21/00

(52) U.S. Cl. ..... 399/297; 399/302; 399/303; 399/308; 399/350

(58) Field of Search ..... 399/297, 302, 399/303, 308, 350, 351

(56) References Cited

U.S. PATENT DOCUMENTS 4,465,362 A * 8/1984 Tohma et al.
5,121,166 A * 6/1992 Miyamoto et al. ..... 399/350 X
5,742,873 A 4/1998 Kubo et al. ..... 399/98
5,835,821 A 11/1998 Suzuki et al. ..... 399/100
5,915,156 A * 6/1999 Kizaki et al. ..... 399/346
6,014,530 A * 1/2000 Tsunemi ..... 399/350 X
6,026,255 A * 2/2000 Kizaki et al. ..... 399/346 X
6,160,980 A * 12/2000 Ziegelmuller et al. ..... 399/303
6,333,132 B1 * 12/2001 Tomura ..... 399/298 X
6,341,207 B1 * 1/2002 Sasaki et al. ..... 399/150 X

FOREIGN PATENT DOCUMENTS

JP 9-69649 4/1997

* cited by examiner

*Primary Examiner*—Fred L. Braun
(74) *Attorney, Agent, or Firm*—Fitzpatrick, Cella, Harper & Scinto

(57) ABSTRACT

An image forming apparatus has a plurality of image bearing members which are disposed along the conveying direction of transfer material and on which latent images are formed. Developing devices are disposed corresponding to the plurality of image bearing members and develop the latent images with developers. A transfer material bearing and conveying member and a transfer device to sequentially transfer the developer images developed on the plurality of image bearing members to the transfer material on the transfer material bearing and conveying member are also a part of the image forming apparatus. The apparatus also has a cleaning member which cleans the surface of the transfer material bearing and conveying member. A developer image that is not to be transferred onto the transfer material is formed only onto one image bearing member disposed downstream in the movement direction of the transfer material bearing and conveying member among the plurality of image bearing members. The developer image is transferred onto the transfer material bearing and conveying member by the transfer member and the transfer material bearing and conveying member is moved so that the transferred developer image reaches the cleaning member.

32 Claims, 15 Drawing Sheets

IMAGE FORMING APPARATUS WITH CLEANING MEMBER

BACKGROUND OF THE INVENTION

1. Field of the Invention

The present invention relates to an image forming apparatus of an electrophotographic system or of electrostatic recording system to be treated as, for example, a photocopier or a printer, etc.

2. Related Background Art

A color image forming apparatus adopting a so-called tandem system, which comprises a plurality of image forming stations (hereinafter referred to as "station") so that respective stations form toner images having respectively different colors and those toner images are superimposed sequentially and are transferring to forma color image, is conventionally known.

In each station described above, after a charging device has charged an image bearing member, the exposure of writing is executed corresponding to image signals with a semiconductor laser or an LED, etc. to form an electrostatic latent image onto the image bearing member, this electrostatic latent image is visualized as a toner image by developing means, and this toner image is transferred onto a recording material such as a transferring sheet or a film, etc. by a transfer device. In addition, the recording material after transferring is conveyed to a fixing device so that a toner image is fixed by the fixing device to give rise to the image.

In addition, in the recent image forming apparatus, those that are configured by using a belt running member such as a conveying belt being recording material bearing and conveying means for conveying a recording material to a plurality of stations in order to comply with full coloring and an increase in speed of the image forming apparatus are increasing in number. Otherwise, some are configured to sequentially transfer images in a plurality of stations onto an intermediate transfer belt as an intermediate transfer member to transfer the images onto the recording material. Various proposals have been made for a cleaning means to remove the toner attached to the surface of these belt members but it is well known that a cleaning blade, which is a plate-shaped cleaning member made of an elastic material such as rubber, etc. and has its edge brought into contact with the belt running member to scrape off and remove the attached toner, is already provided for practical use due to its simple configuration and high cost performance with good attached toner removing function.

Incidentally, in the color image forming apparatus configured as described above, long-term use of the apparatus is accompanied by NOx and toner resin, etc., for example, being attached onto the surface of the belt running member, and thus the surface friction coefficient of the belt running member rises up so that the friction force between the edge portion of the cleaning blade and the belt running member (the contact portion) will become large. Thereby, energy accumulated in the edge portion of the cleaning blade in a stick state will become large so that the Stick-Slip movement will be featured by the amplitude>a proper value and the frequency<a proper value. Incidentally, the proper values are defined as a range in which a cleaning operation is executed stably.

Here, the Stick-Slip movement means the phenomena in which when the cleaning blade is brought into pressure contact with the surface of the belt running member with a force necessary to remove the residual toner on the surface of the belt running member, at first the edge portion tightly attached to the surface of the belt running member by the friction force applied to the contact portion undergoes deformation (slip deformation and compression deformation) in the travelling direction of the belt running member, and subsequently the energy accumulated in the edge portion accompanied by that stress functions as a force of restitution (impact resilience force) and gets back to the original state.

When these phenomena progress, the edge portion of the cleaning blade leaps up without following the surface of the belt running member, and passing-through of the toner or rubbing of the toner onto the surface of the belt running member (toner fusion bond and filming) takes place, and moreover, abnormal sounds (blade noise-making) and abnormal vibration (trembling) take place, a so-called blade turning up causing the edge portion to reverse so as to go along the direction of rotation of the belt running member takes place, or otherwise the edge portion or the surface of the belt running member could suffer from damages (chipping off in the blade edge or scratches on the surface of the belt running member).

In order to solve this problem, such measures are generally taken in which solid powder (lubricant) of inorganic substances such as graphite, boron nitride, molybdenum disulfide, tungsten disulfide, silicon dioxide, etc. and organic substances such as fluorine contained resin, silicone resin, polyamide (nylon resin), polyacetal, polyethylene, and polyimide, etc. are applied to the contact portion in which the edge portion of the cleaning blade is brought into contact with the belt running member so as to reduce the friction force.

However, since the lubricant will get lost from the edge portion of the cleaning blade due to long term use of the apparatus and the friction force will increase again, it will not be an essential key to reduce the friction force between the edge portion of the cleaning blade and the belt running member. In addition, to take these measures, a variety of apparatuses are used to supply the edge portion of the cleaning blade with the above described lubricant regularly, and as a result thereof, the configuration of the cleaning device will get complicated resulting in a significant cost increase.

In addition, as a method to plan reduction in the friction force between the cleaning blade and the belt running member, there is a method to use a cleaning blade in which a nylon resin layer is disposed on the contact surface with the belt running member (hereinafter referred to as "nylon coat blade"). In the case where this nylon coat blade is used, it is sufficiently possible to reduce the friction force between its edge portion and the belt running member.

However, unlike polyurethane, the nylon resin does not have properties as an elastomer, and does not show any function of removing the residual toner with Stick-Slip movement in the edge portion of the cleaning blade, but operates to clog the residual toner and to scrape off the residual toner and the like. Therefore, in order to completely prevent passing-through of the residual toner, it is necessary to increase the pressing force of the cleaning blade against the surface of the belt running member more considerably than in the case of polyurethane blade (approximately twice the polyurethane blade), and consequently inconveniences such as increase in abrasion wear in the surface of the belt running member due to cleaning blade or occurrences of scratches will take place, thus giving rise to such a problem that the life of the belt running member gets short takes place.

SUMMARY OF THE INVENTION

Under the circumstances, the present invention has been made in view of the above described problems, and the object thereof is to provide an image forming apparatus comprising a cleaning member that maintain good cleaning performance at a low cost even under a long-term use and can prevent abnormal sounds or abnormal vibration, and occurrence of turning up.

In order to attain the above described object, a first invention provides an image forming apparatus having:

a plurality of image bearing members which are disposed along the conveying direction of the transfer material and on which latent images are formed;

developing means which are disposed corresponding to the plurality of image bearing members and develope the latent images with a developer, respectively;

transfer material bearing and conveying means to bear and convey the transfer material;

transfer means to sequentially transfer the developer images developed on the plurality of image bearing members to the transfer material on the transfer material bearing and conveying means; and a cleaning member which is brought into contact with the transfer material bearing and conveying means and cleans the surface of the transfer material bearing and conveying means, wherein the developer image without undergoing transfer onto the transfer material is formed only onto an image bearing member disposed downstream-most in the movement direction of the transfer material bearing and conveying means among the plurality of image bearing members; and the developer image is transferred onto the transfer material bearing and conveying means by the transfer means; and the transfer material bearing and conveying means are moved so that the transferred developer image reaches the cleaning members.

In addition, a second invention to attain the above described object provides an image forming apparatus having:

a plurality of image bearing members which are disposed along the moving direction of the intermediate transfer means and on which a latent image is formed;

developing means which are disposed corresponding to the plurality of image bearing members and develop the latent images with a developer, respectively;

primary transfer means to sequentially transfer the developer images developed on the plurality of image bearing members to the intermediate transfer means;

secondary transfer means to transfer the developer images transferred onto the intermediate transfer means to a transfer material; and a cleaning member which is brought into contact with the intermediate transfer means and cleans the surface of the intermediate transfer means, wherein the developer image without undergoing transfer onto the transfer material is formed only onto an image bearing member disposed downstream-most in the movement direction of the intermediate transfer means among the plurality of image bearing members; and the developer image is transferred onto the intermediate transfer means by the primary transfer means; and the intermediate transfer means are moved so that the transferred developer image reaches the cleaning member.

According to the above described configuration, the developer image is formed only on the image bearing member disposed downstream-most among the plurality of image bearing members, and can supply the developer image to the cleaning member, and therefore, can maintain good cleaning performance saving the running cost by reducing useless consumption of the developer and can prevent abnormal sounds or abnormal vibration, and occurrence of turning up.

DESCRIPTION OF THE PREFERRED EMBODIMENTS

An image forming apparatus according to the present invention will be described further in detail with reference to the accompanying drawings.

Embodiment 1

Figure 1:
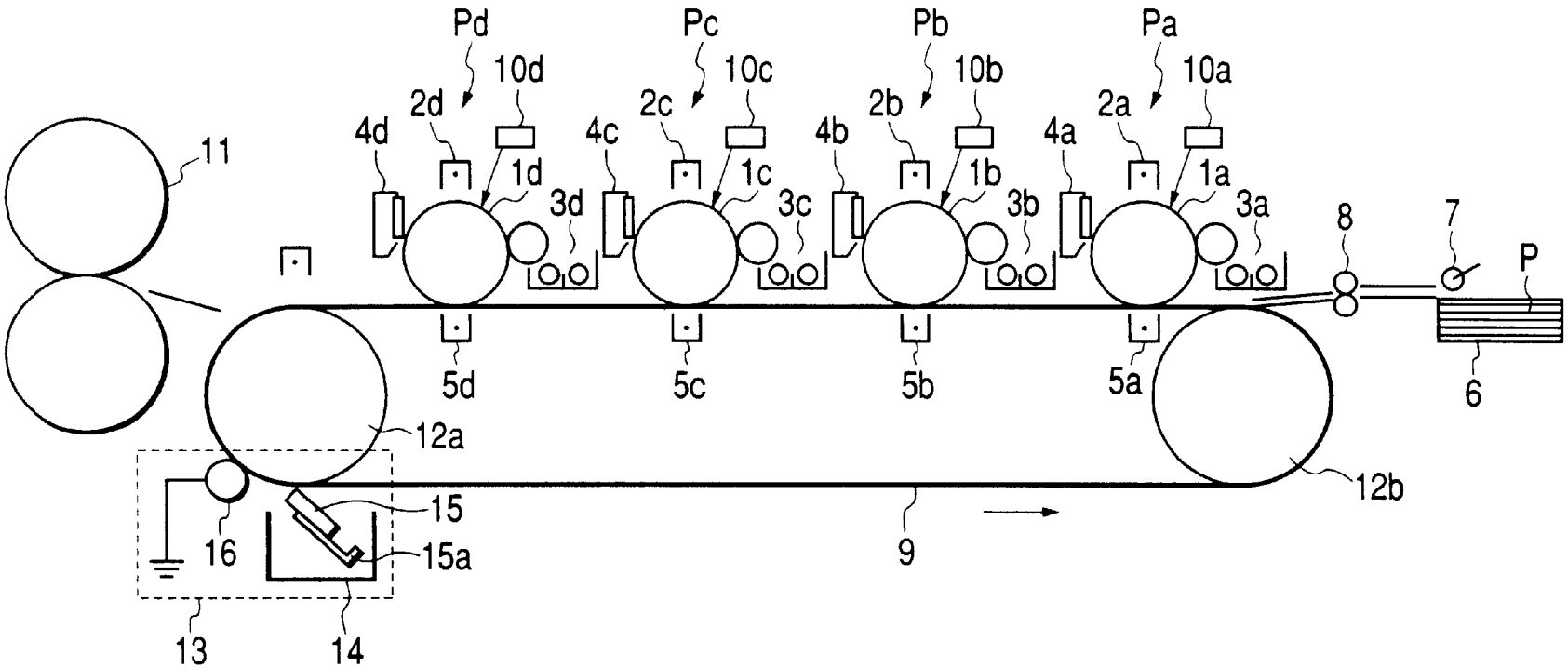
FIG. 1 is a schematic configuration view showing an embodiment of a color image forming apparatus according to the present invention.

A first embodiment of the present invention will be described with reference to FIG. 1 and FIG. 2.

At first, with reference to FIG. 1, a color photocopier of an electrophotographic system being an image forming apparatus of this embodiment will be described.

The color photocopier of this embodiment adopts a so-called tandem system which comprises a plurality of image forming stations (hereinafter referred to as "station") Pa, Pb, Pc and Pd so that respective stations Pa–Pd form toner images having respectively different colors and those toner images are transferred superimposed sequentially on the same recording material to form a color image.

In the respective stations Pa to Pd, photosensitive drums 1*a,* 1*b,* 1*c,* and 1*d* as image bearing members are uniformly charged by the charging device 2*a,* 2*b,* 2*c* and 2*d* and laser oscillators 10*a,* 10*b,* 10*c* and 10*d* irradiates the charged photosensitive drums with laser beams according to the image signals. Electrostatic latent images are formed in the portions on the photosensitive drums 1*a* to 1*d* where the laser light beams are irradiated, and are developed by the toners as developers by the developing devices 3*a,* 3*b,* 3*c* and 3*d* as developing means and are visualized.

In the cassette 6, transfer material (recording material) P such as a sheet of paper is piled up, separated and fed one by one by the feed roller 7, undergo skew feed correction by the registration roller pair 8, thereafter is attracted onto the conveying belt 9 as the transfer material bearing and conveying means, and is conveyed to the stations Pa to Pd. The toner images born on the photosensitive drums 1*a* to 1*d* are transferred by the transfer charging devices 5*a,* 5*b,* 5*c* and 5*d* as transfer means onto the sheet P conveyed by the conveying belt 9, and thereafter the sheet P is conveyed to the fixing device 11 so that heat and pressure is applied thereto and the toner image is fixed, and then is discharged outside the apparatus.

The residual toner on the photosensitive drums 1*a* to 1*d* after the toner images are transferred are removed by the cleaning devices 4 (4*a,* 4*b,* 4*c,* 4*d*) and the photosensitive drums are served for image forming again.

In addition, the residual toner on the conveying belt 9 after the recording material P is conveyed to the fixing device 11 is removed by a cleaning device 13 to get ready for next image forming.

The toner used in this embodiment is a two-component developer which is a mixture of polymer toner produced by the suspension polymerization method configured by a core containing an ester wax inside, a resin layer made of styrene butyl acrylate, and the surface layer made of styrene polyester to which titanic acid strontium was added from outside, and a resin magnetic carriers produced by polymerizing method.

(Transfer material bearing and conveying means)

The transfer material bearing and conveying means of this embodiment have two rollers supported by the supporting frame (not shown), that is, a drive roller 12*a* by the friction force to drive the conveying belt 9 and a tension roller 12*b* to apply a tension of a constant stress to the conveying belt 9 and the conveying belt 9, and are configured so as to be capable of swinging and contacting/separating with the photosensitive drums 1*a* to 1*d* around the drive roller 12*a* as a center, to get closer to the photosensitive drums 1*a* to 1*d* only during image forming operation, to convey the recording material P with the conveying belt 9 being driven at the same running speed as that of the photosensitive drums 1*a* to 1*d,* and to transfer to the recording material P the toner images formed on the photosensitive drums 1*a* to 1*d* by the transfer devices 5*a* to 5*d* provided opposite to the photosensitive drums 1*a* to 1*d* with the conveying belt 9 interposed therebetween.

The material of the conveying belt 9 of this embodiment is a polyimide resin containing carbon for resistance adjustment, but otherwise a number of polystomer and elastomer such as polyethylene terephthalate resin, polyvinylidene fluoride resin, polycarbonate resin, and polyurethane resin, etc. may be used as material.

The transfer devices 5*a* to 5*d,* for which in this embodiment non-contact corona charger was used, may be, for example, a roller charger and a blade charger, etc. in contact system, giving rise to no problem. As described above, when images are not formed, the conveying belt is separated from the photosensitive drums so as to be configured to protect the photosensitive drums.

(Cleaning device)

The cleaning device 13 of the conveying belt 9 comprises a charge eliminating device 16 and a casing 14 having an opening portion at the side of the conveying belt 9, and to this opening portion a plate-shaped cleaning blade 15 as a cleaning member made of urethane rubber, etc. is attached with a supporting member 15*a*. The cleaning device 13 is mounted onto the supporting frame of the transfer material bearing and conveying means, and the cleaning blade 15 brings its one edge into contact with the conveying belt 9 opposite to the drive roller 12*a,* and the residual toner on the conveying belt 9, which reaches the edge, is scraped off by the cleaning blade 15. The toner scraped off drops inside the casing 14 and is discharged from the cleaning device 13 with a screw (not shown) as conveying means to discharge the residual toner. Thus, due to such a configuration, the interior of the casing 14 will never be clogged with the residual toner.

Figure 2:
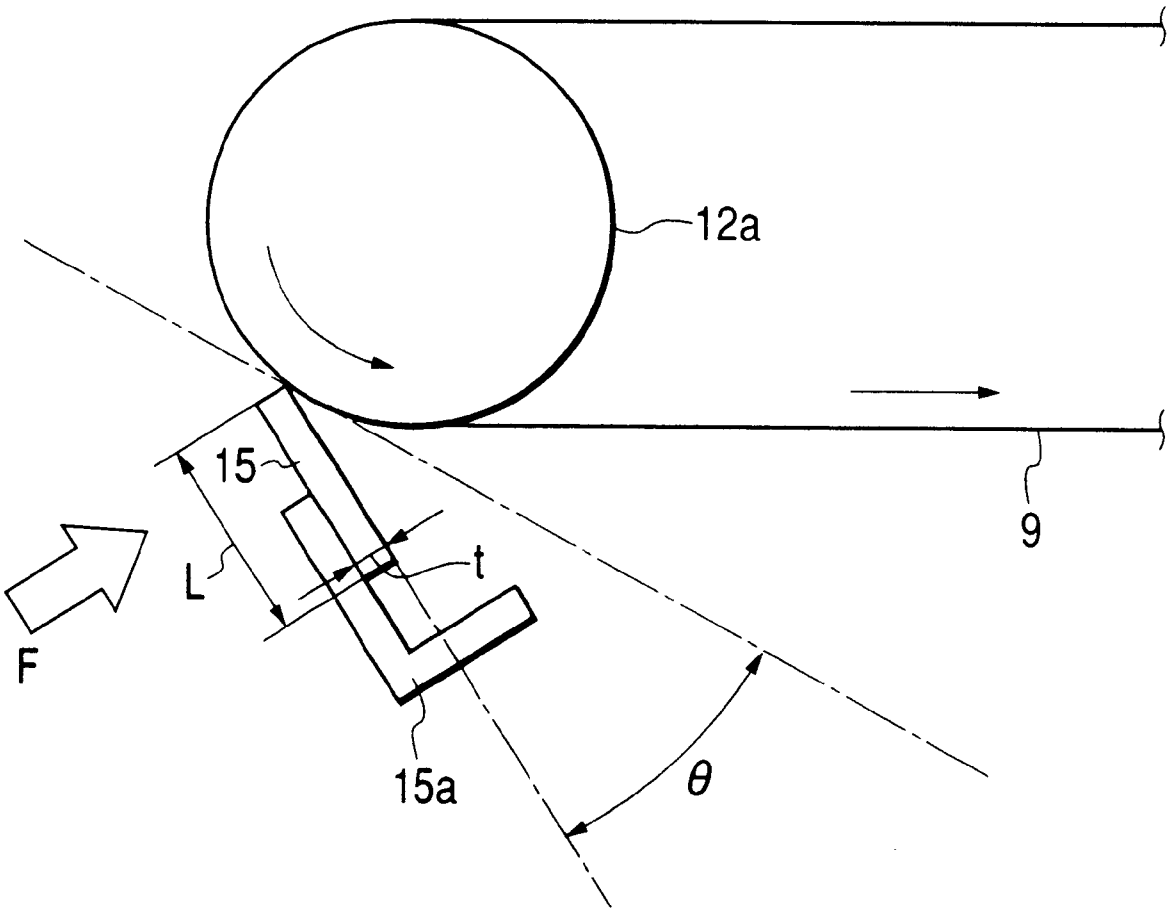
FIG. 2 is an explanatory view showing how the cleaning blade and the conveying belt are brought into contact with each other.

Here, the setting conditions to bring the cleaning blade 15 into contact with the conveying belt 9, as shown in FIG. 2, are represented by the abutting force F, the abutting angle θ, the free length L, and the plate thickness t of the cleaning blade 15. In this embodiment, in order to stabilize the abutting force F of the cleaning blade 15 against the conveying belt 9, a pressing system by a spring (not shown) is used. The abutting force F=1000 gf(=9.8 N), the abutting angle θ=30°, the free length L=10 mm, and the plate thickness t=2 mm were taken for the cleaning blade 15.

The cleaning blade 15 used in this embodiment is made of polyurethane rubber, and the values of solid state properties of the cleaning blade 15 are measured according to the testing method on vulcanized rubber in JIS (Japanese Industrial Standard), resulting in A hardness with 73° and impact resilience modulus being 50%.

From the view point of the cleaning means of a scraping-off type as described above, the conveying belt 9 is preferably seamless or is a so-called seamless belt. However, in the case of a belt having seams, means to separate off the cleaning blade from the belt at the seam portion and the like may be well considered.

However, as a cleaning device 13 for the conveying belt 9, the blade system comprising elastic member such as rubber, etc. as described above is used, but the reason hereof is that the configuration of the blade system is simple, small, and advantageous in terms of cost issues. In addition, as the material of the cleaning blade 15, polyurethane rubber being a kind of thermoplastic elastomer is used as described above, from the view point of the chemical-resistance, the abrasive-resistance, the moldering performance, and the mechanical intensity. In addition, this embodiment adopted a method to bring the cleaning blade 15 into pressure contact with the surface of the running conveying belt 9 from the counter direction.

The cleaning mechanism in this system is deemed to take place due to so-called Stick-Slip movement, in which when the cleaning blade 15 is brought into pressure contact with the surface of the conveying belt 9 with a linear load (5 gf/cm=0.49 N/m) necessary to remove the residual toner on the surface of the conveying belt 9, the edge portion of the cleaning blade 15 which has been brought into tight contact with the surface of the conveying belt 9 with a friction force applied to the abutting portion undergoes deformation (slip deformation and compression deformation) in the travelling direction of the conveying belt 9 in the abutting portion between the edge portion of that cleaning blade 15 and the conveying belt 9, and subsequently the energy accumulated in the edge portion of the cleaning blade 15 accompanied by that stress functions as a force of restitution (impact resilience force) and gets back to the original state.

Accordingly, in order to obtain the stable cleaning performance in the cleaning device 13 using the cleaning blade 15, the amplitude and frequency of the Stick-Slip movement need to be made proper, and this can be attained by adjusting the friction force in the abutting portion on the surface of the edge portion of the cleaning blade 15 and the conveying belt 9, the shape of the cleaning blade 15, the material properties of the cleaning blade 15 (Young's modulus, Poisson's ratio, and modulus (stress-strain curve)), etc.

However, as described above, accompanied by a long-term use of the apparatus, the Stick-Slip movement will be featured by the amplitude>a proper value and the frequency<a proper value. In addition, when these phenomena progress, as described above in detail, various inconveniences take place.

Under the circumstances, at a predetermined timing other than at the time of image forming, employed was such a configuration that a solid or half tone belt image having a width covering the entire region of the main scanning direction or a likewise width and of several mm to several tens mm in the sub-scanning direction is formed on the photosensitive drum, undergoes transfer operation in the transfer region, forms an image directly onto the conveying belt 9, and causes the toner forming that belt image to reach the edge portion of the cleaning blade 15. By activating the abrasive and lubricant function with this toner, also in long-term use, so-called blade turning-up in which the edge portion of the cleaning blade 15 rides up so as to be directed along the running direction of the conveying belt by the friction between the edge portion and the surface of the conveying belt could be prevented from taking place.

Incidentally, the belt image forming sequence in this embodiment was executed at timings shown below.

1) At the time of the rise of the main power supply of the image forming apparatus and 2) at respective timings every image forming of 500 images, a solid belt image in the entire main scanning direction and 10 mm in the sub-scanning direction is formed on the photosensitive drum, and is caused to undergoes transfer operation in the transfer region, forms the image directly onto the conveying belt 9, and causes the toner forming that belt image to reach the edge portion of the cleaning blade 15.

An effect to abrade the attached substance on the surface of the conveying belt 9 with the toner to hold the state of the surface of the conveying belt 9 constant and an effect to improve the lubricant performance of the edge portion of the cleaning blade 15 as described above largely depend on titanic acid strontium which was added to toner particles from outside, and otherwise fine powders of such as silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, titanic acid calcium, titanic acid magnesium, tungstic acid phosphorus, molybdenum acid phosphorus, calcium carbonate, magnesium carbonate, and aluminum carbonate, etc. can be nominated, or use of abrasive agent with Mohs' scale of hardness of not less than 6.0 give rise to an effect to abrade and remove the attached substance on the conveying belt surface as well. In addition, in the case where any of them is added from outside, a similar effect appears.

In addition, with this configuration at a low cost, it was possible to plan to prevent abnormal sounds or abnormal vibration from taking place and to stabilize the cleaning function with the effect to abrade the attached substance on the surface of the conveying belt 9 to hold the state of the surface of the conveying belt 9 constant and the effect to improve the lubricant performance of the edge of the cleaning blade 15.

Incidentally, the region of the belt image and the timing to form the belt image shall not be limited to this embodiment, but from the point of view of running costs, a method involving the direction which can make toner consumption as little as possible, that is, involving less area to form the belt image and few times of forming is desirable.

Embodiment 2

Next, a second embodiment of the present invention will be described with reference to FIG. 3, FIG. 4, FIG. 5A and FIG. 5B.

Since the configuration and the performance of the image forming apparatus in this embodiment is nearly the same as those in the first embodiment, description will be omitted.

This embodiment comprises a strain gage as detecting means to detect the deformation of the cleaning blade, and based on signals obtained from the strain gage, forms an image on the photosensitive drum, undergoes transfer operation in the transfer region, forms images directly onto the conveying belt, and causes the toner forming that image to reach the cleaning blade. It will be described as follows.

Figure 3:
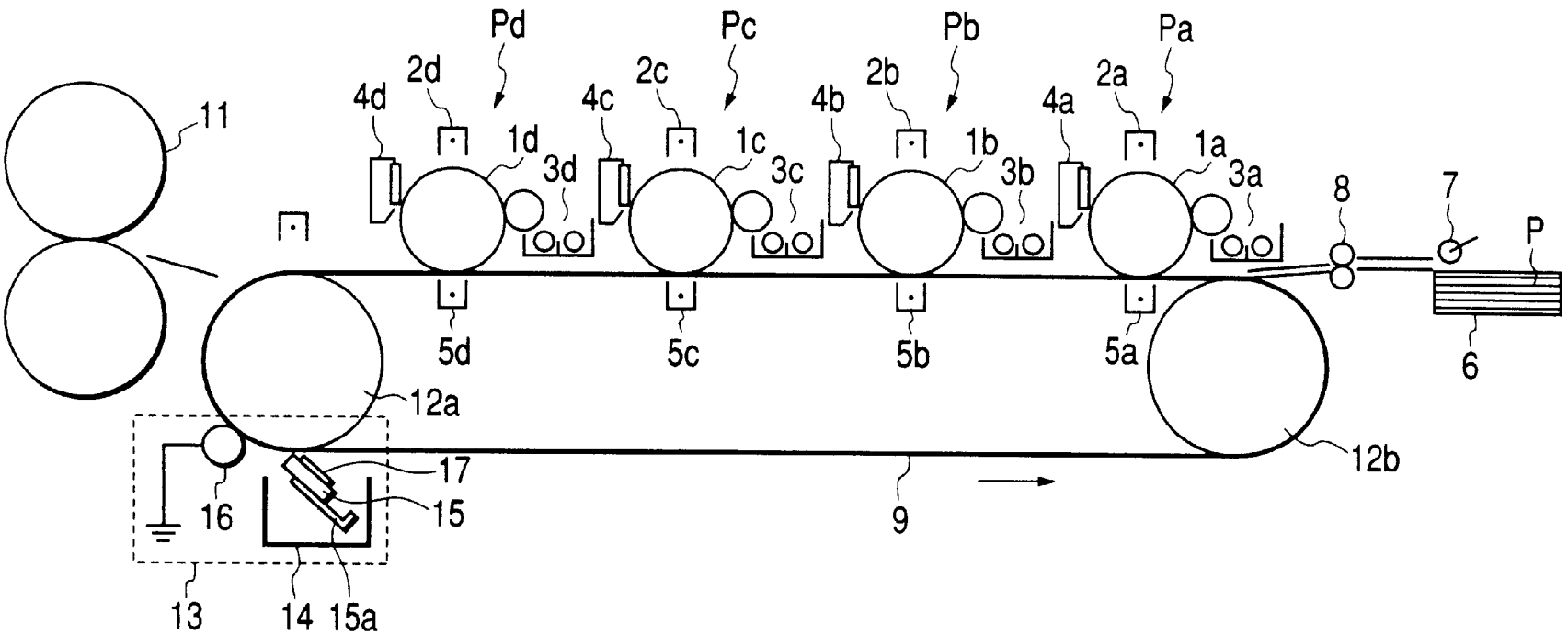
FIG. 3 is a schematic configuration view showing another embodiment of the color image forming apparatus according to the present invention.
Figure 4:
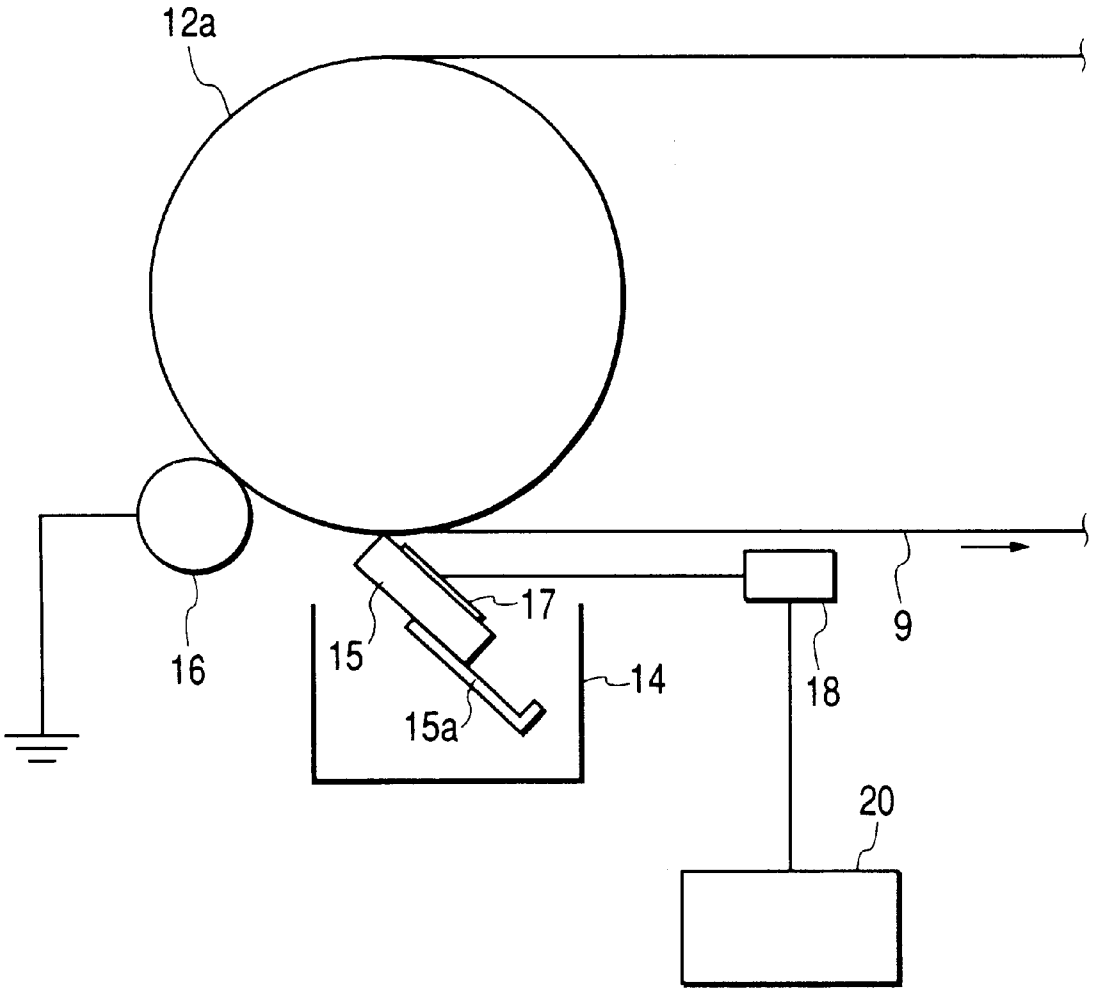
FIG. 4 is an enlarged view showing a conveying belt cleaning device in the color image forming apparatus in FIG. 3.

As shown in FIG. 3 and FIG. 4, the strain gage 17 as detecting means is stuck on the surface of the downstream side of the cleaning blade 15 in the moving direction of the conveying belt 9.

Figure 5A:
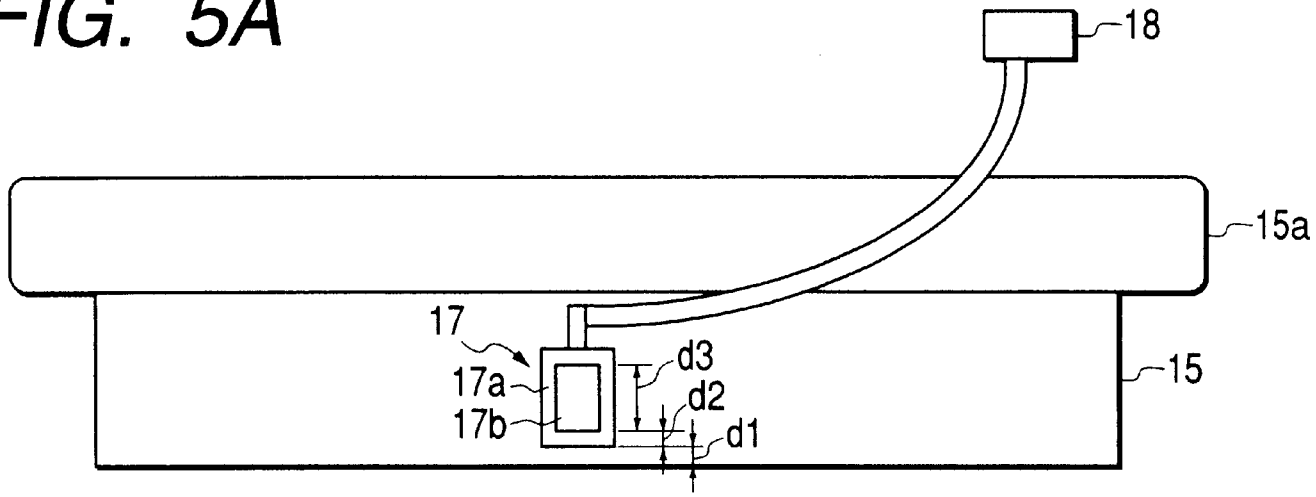
FIGS. 5A and 5B are drawings to show a strain gage stuck onto the cleaning blade in FIG. 4 and its bridge circuit.
Figure 5B:
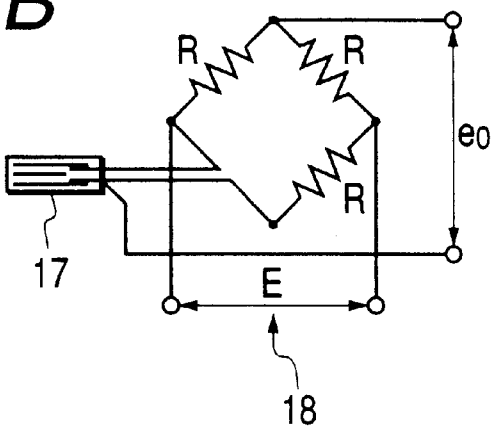

In addition, this embodiment uses KFG-02-120-C1-11L3M3R of 3-line system with gage ratio of 2.1 manufactured by KYOWA Electronic Instruments Co., Ltd. as the strain gage 17, and uses DB-120P manufactured by KYOWA Electronic Instruments Co., Ltd. as the bridge circuit 18 (in FIG. 5B), and as shown in FIG. 5A, was stuck so as to be directed along the moving direction of the conveying belt 9 apart by d1=1 mm from the edge of the cleaning blade 15. Incidentally, the strain gage 17 is shaped rectangular and the sensor main body 17*b* of length d3=2 mm is disposed in a position inwardly apart from the edge of the supporting member 17*a* by d2=1 mm.

The strain $\epsilon 0$ in the strain gage 17 can be relatively calculated from the output voltage e0 by the equation (1) described below.

$$e0=E/4(Ks\cdot\epsilon 0) \quad (1)$$

The image forming apparatus in this embodiment has a control device 20 to receive the strain amount of the cleaning blade 15 outputted from the strain gage 17 stuck onto the cleaning blade 15, and in the case where the strain amount of the cleaning blade 15 is 1 at the time when the cleaning blade 15 and the conveying belt 9 are under the non-contact state, maintains the strain amount within a range of 1 to 5.

The equation (1) includes Ks: gage ratio and E: bridge voltage.

In this embodiment, the output (signals) from the strain gage 17 are monitored by the control device 20, and in the case where the strain amount of 5 is detected, the belt image forming sequence as described in the first embodiment is executed, and at the time point when the strain amount reached 3, the belt image forming sequence is completed and the normal state comes back.

With such configuration, stabilization on the cleaning function is attained by the effect to abrade the attached substance on the surface of the conveying belt 9 to hold the state of the surface of the conveying belt 9 constant and the effect to improve the lubricant performance of the edge portion of the cleaning blade 15.

An effect to abrade the attached substance on the surface of the conveying belt 9 with the toner to hold the state of the surface of the conveying belt 9 constant and an effect to improve the lubricant performance of the edge portion of the cleaning blade 15 as described above largely depend on titanic acid strontium which was added to toner particles from outside, and otherwise fine powders of such as silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, titanic acid calcium, titanic acid magnesium, tungstic acid phosphorus, molybdenum acid phosphorus, calcium carbonate, magnesium carbonate, and aluminum carbonate, etc. can be nominated, or use of abrasive agent with Mohs' scale of hardness of not less than 6.0 give rise to an effect to abrade and remove the attached substance on the conveying belt surface as well. In addition, in the case where any of them is added from outside, a similar effect appears.

In addition, from the point of view of running costs, the direction which can make toner consumption as little as possible, that is, makes less area to form the belt image and few times of forming is desirable, and the image forming apparatus in this embodiment detects the strain of the cleaning blade so as to execute the belt image forming operation only when blade turning up is about to take place, and therefore can reduce a number of times of belt image forming, giving rise to an effect to decrease the running costs.

It was described that when this embodiment detects the strain amount of 5, it executes the belt image forming sequence as described in the first embodiment and the belt image forming sequence is completed at the time point when the strain amount reaches 3, but it is desirable that execution conditions of this sequence should be optimized according to conditions of the image forming apparatus such as qualities of the cleaning blade and the conveying belt.

Incidentally, the strain gage shall of course not be limited to the above described type, nor the sticking position be limited, either.

Embodiment 3

Figure 6:
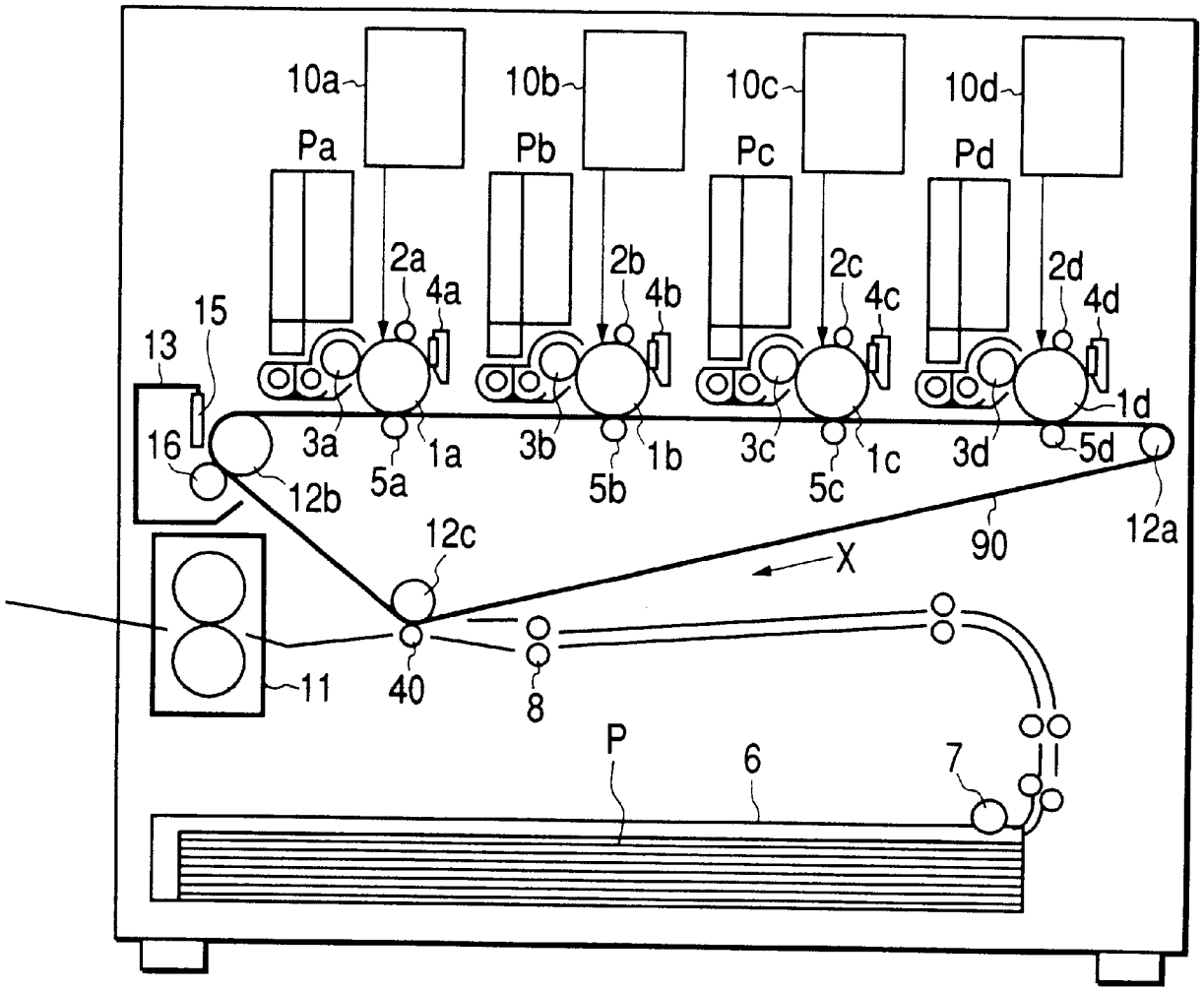
FIG. 6 is a schematic configuration view showing another embodiment of the color image forming apparatus according to the present invention.

Next, the third embodiment of the present invention will be described with reference to FIG. 6. In this embodiment, the present invention was applied to the image forming apparatus comprising an intermediate transfer belt as an intermediate transfer member.

At first, the entire configuration as well as functions of the image forming apparatus of this embodiment will be described with reference to FIG. 6. Incidentally, members having the same functions as those for the above described members will be given the same reference numerals and characters.

The image forming apparatus of this embodiment comprises an intermediate transfer belt 90 as an intermediate transfer member running in the direction indicated by the arrow X and being stretched around a drive roller 12*a,* a driven roller 12*b,* and the secondary transfer opposite roller 12*c,* and above the plane portion thereof nearly similarly configured image forming stations (stations) Pa, Pb, Pc, and Pd are disposed in series.

As described in the first embodiment, the image forming stations Pa to Pd form toner images of magenta, cyan, yellow, and black respectively.

When the toner image in magenta arrives at the primary transfer position in which the photosensitive drum 1*a* and the intermediate transfer belt 90 are in contact with each other, the toner image is transferred to the intermediate transfer belt 90 by the primary transfer bias applied by the primary transfer device 5*a* as the primary transfer charging means. The intermediate transfer belt 90 bearing the magenta toner image is conveyed to the next image forming station Pb, and until then, in the image forming station Pb, the cyan toner image formed on the photosensitive drum 1*b* in the step similar to that described above is transferred onto the magenta toner image.

Likewise, as the recording material P moves forward to the image forming stations Pc and Pd, the yellow toner image and the black toner image are superimposed sequentially onto the above described toner images in the respective primary transfer positions, and no later than this time, the recording material P taken out by the feed roller 7 from the feed cassette 6 reaches the registration roller 8, and thereafter the recording material P is further conveyed to the secondary transfer position defined by the secondary transfer opposite roller 12*c* and the secondary transfer device 40 as the secondary transfer charging means in synchronism with the toner image, and there the above described four color toner images are transferred onto the recording material P by the transfer bias applied to the secondary transfer device 40. The recording material P is further conveyed to the fixing device 11 so that heat and pressure are applied thereto and the toner images are fixed thereon, and then the recording material P is discharged outside the apparatus.

The residual toner on the intermediate transfer belt 90 remaining after the transfer onto the recording material P is collected by the cleaning device 13. This cleaning device 13 comprises a cleaning blade 15 made of polyurethane as described in the first embodiment, and its edge is brought into contact with the intermediate transfer belt 90 to scrape off and remove the attached toner.

However, as having been described above in detail, such problems that increase in abrasion wear in the surface of the belt due to cleaning blade 15 or occurrences of scratches, etc. results in shortage of the life of belt and the like will take place.

Under the circumstances, at a predetermined timing other than at the time of image forming, employed was such a configuration that a solid or half tone belt image having a width covering the entire region of the main scanning direction or a likewise width and of several mm to several tens mm in the sub-scanning direction is formed on the photosensitive drum, undergoes transfer operation in the transfer region, forms an image directly onto the intermediate transfer belt 90, and causes the toner forming that belt image to reach the edge portion of the cleaning blade 15.

Incidentally, the belt image forming sequence in this embodiment was executed at timings shown below.

1) At the time of the rise of the main power supply of the image forming apparatus 2) at respective timings every image forming of 500 images, a solid belt image in the entire main scanning direction and 10 mm in the sub-scanning direction is formed on the photosensitive drum, and is caused to undergoes transfer operation in the transfer region, forms images directly onto the intermediate transfer belt 90, and causes the toner forming that belt image to reach the edge portion of the cleaning blade 15.

An effect to abrade the attached substance on the surface of the intermediate transfer belt 90 with the toner to hold the state of the surface of the intermediate transfer belt 90 constant and an effect to improve the lubricant performance of the edge portion of the cleaning blade 15 as described above largely depend on titanic acid strontium which was added to toner particles from outside, and otherwise fine powders of such as silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, titanic acid calcium, titanic acid magnesium, tungstic acid phosphorus, molybdenum acid phosphorus, calcium carbonate, magnesium carbonate, and aluminum carbonate, etc. can be nominated, or use of abrasive agent with Mohs' scale of hardness of not less than 6.0 give rise to an effect to abrade and remove the attached substance on the conveying belt surface as well. In addition, in the case where any of them is added from outside, a similar effect appears.

By activating the abrasive and lubricant function with this toner, so-called blade turning-up in which the edge portion of the cleaning blade 15 rides up so as to be directed along the running direction of the intermediate transfer belt 90 by the friction between the edge portion and the surface of the intermediate transfer belt 90 could be prevented from taking place.

In addition, with this configuration, it is possible to plan to prevent abnormal sounds or abnormal vibration from taking place and to stabilize the cleaning function with the effect to abrade the attached substance on the surface of the intermediate transfer belt 90 with the toner to hold the state of the surface of the intermediate transfer belt 90 constant and the effect to improve the lubricant performance of the edge of the cleaning blade 15.

Incidentally, the region of the belt image and the timing to form the belt image shall not be limited to this embodiment, but from the point of view of running costs, a method involving the direction which can make toner consumption as little as possible, that is, involving less area to form the belt image and few times of forming is desirable.

Embodiment 4

Figure 7:
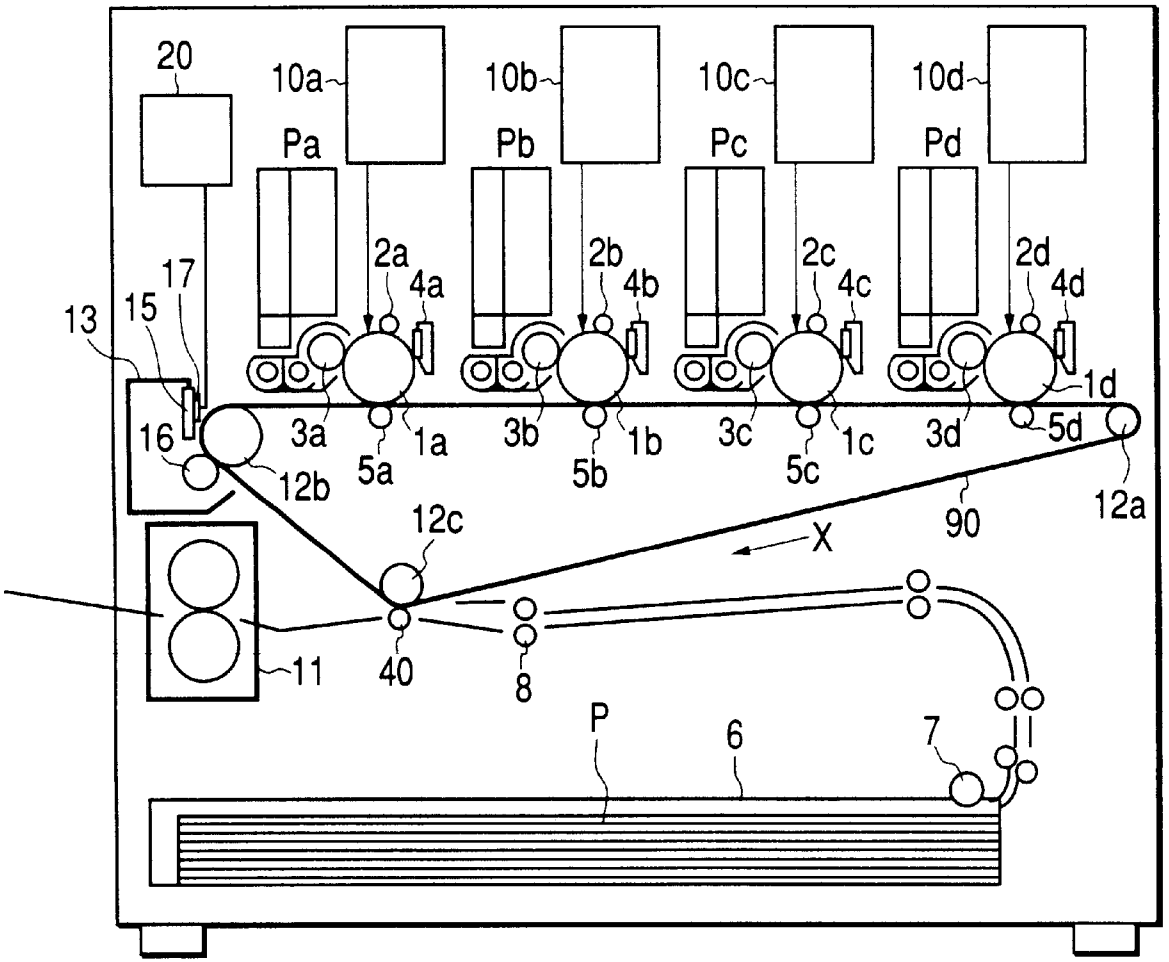
FIG. 7 is a schematic configuration view showing still another embodiment of the color image forming apparatus according to the present invention.

Next, the fourth embodiment of the present invention will be described with reference to FIG. 7.

The image forming apparatus of this embodiment is configured nearly similarly to the third embodiment, that is, comprises a cleaning device 13 comprising the intermediate transfer belt 90 and the cleaning blade 15, and the strain gage 17 similar to that described in the second embodiment is stuck on the cleaning blade 15 on the side of the intermediate transfer belt 90.

In this embodiment, the output from the strain gage 17 is monitored by the control device 20, and in the case where the strain amount of 5 set in advance as described above is detected, the belt image forming sequence as described in the first embodiment is executed, and at the time point when the strain amount reached 3, the belt image forming sequence is completed and the normal state comes back.

With such configuration, stabilization on the cleaning function is attained by the effect to abrade the attached substance on the surface of the intermediate transfer belt 90 to hold the state of the surface of the intermediate transfer belt 90 constant and the effect to improve the lubricant performance of the edge portion of the cleaning blade 15, and at the same time, the number of times of belt forming can be reduced and thus an effect to lower the running costs was attained.

An effect to abrade the attached substance on the surface of the intermediate transfer belt 90 with the toner to hold the state of the surface of the intermediate transfer belt 90 constant and an effect to improve the lubricant performance of the edge portion of the cleaning blade 15 as described above largely depend on titanic acid strontium which was added to toner particles from outside, and otherwise fine powders of such as silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, titanic acid calcium, titanic acid magnesium, tungstic acid phosphorus, molybdenum acid phosphorus, calcium carbonate, magnesium carbonate, and aluminum carbonate, etc. can be nominated, or use of abrasive agent with Mohs' scale of hardness of not less than 6.0 give rise to an effect to abrade and remove the attached substance on the conveying belt surface as well. In addition, in the case where any of them is added from outside, a similar effect appears.

Embodiment 5

Next, the fifth embodiment of the present invention will be described with reference to FIG. 8 to FIG. 16.

The image forming apparatus of this embodiment comprises a configuration nearly similar to that in the first embodiment, but is differentiated by comprising a cleanerless system as well as the magnetic brush charging device. Accordingly, in the description below, the portions different from those in the first embodiment will be mainly described, and at that time, members having the same functions as those for the above described members will be given the same reference numerals and characters for description.

(Cleanerless system)

The image forming apparatus of this embodiment has so-called cleanerless system which does not comprise any exclusive cleaning means to remove the toner remaining on the surface of the photosensitive drums 1*a* to 1*d* without undergoing transfer onto the recording material P in the transfer positions. That is, the transfer residual toner, which reaches the magnetic brush charging devices 2*a*, 2*b*, 2*c* and 2*d* as a contact charging member being charging means with subsequent rotation of photosensitive drums 1*a* to 1*d*, is temporally collected in the magnetic brush portion being in contact with the photosensitive drums 1*a* to 1*d*, and that collected toner is again vomited onto the photosensitive drums 1*a* to 1*d* and is finally collected by the developing devices 3*a*, 3*b*, 3*c* and 3*d* so that the photosensitive drums 1*a* to 1*d* are served for repeating image formation.

In addition, in the case where the toner taken in into the magnetic brush charging devices 2*a* to 2*d* is imparted with electric charges polarized same as the potential of the photosensitive member induced by contact with the magnetic brush carriers (magnetic particles, charged carriers), the toner taken in into the magnetic brush is vomited to the surface of the photosensitive member from inside the magnetic brush by an electric field induced by the potential difference $\Delta V$ between the potential of the photosensitive member and the applying bias being applied to the magnetic brush charging devices 2*a* to 2*d*.

For example, as disclosed in Japanese Patent Application Laid-Open No. 9-96949, etc., such a method is known that, utilizing this principle, decreases the amplitude Vpp of the AC component (alternate component) of the charging bias at the non-image forming operation (on non-image formation)

or halts the application of the AC component so as to make the potential difference ΔV large and to cause the toner to be actively vomited to control increase in electric resistance of the magnetic brush.

(Magnetic brush charging device)

Figure 9:
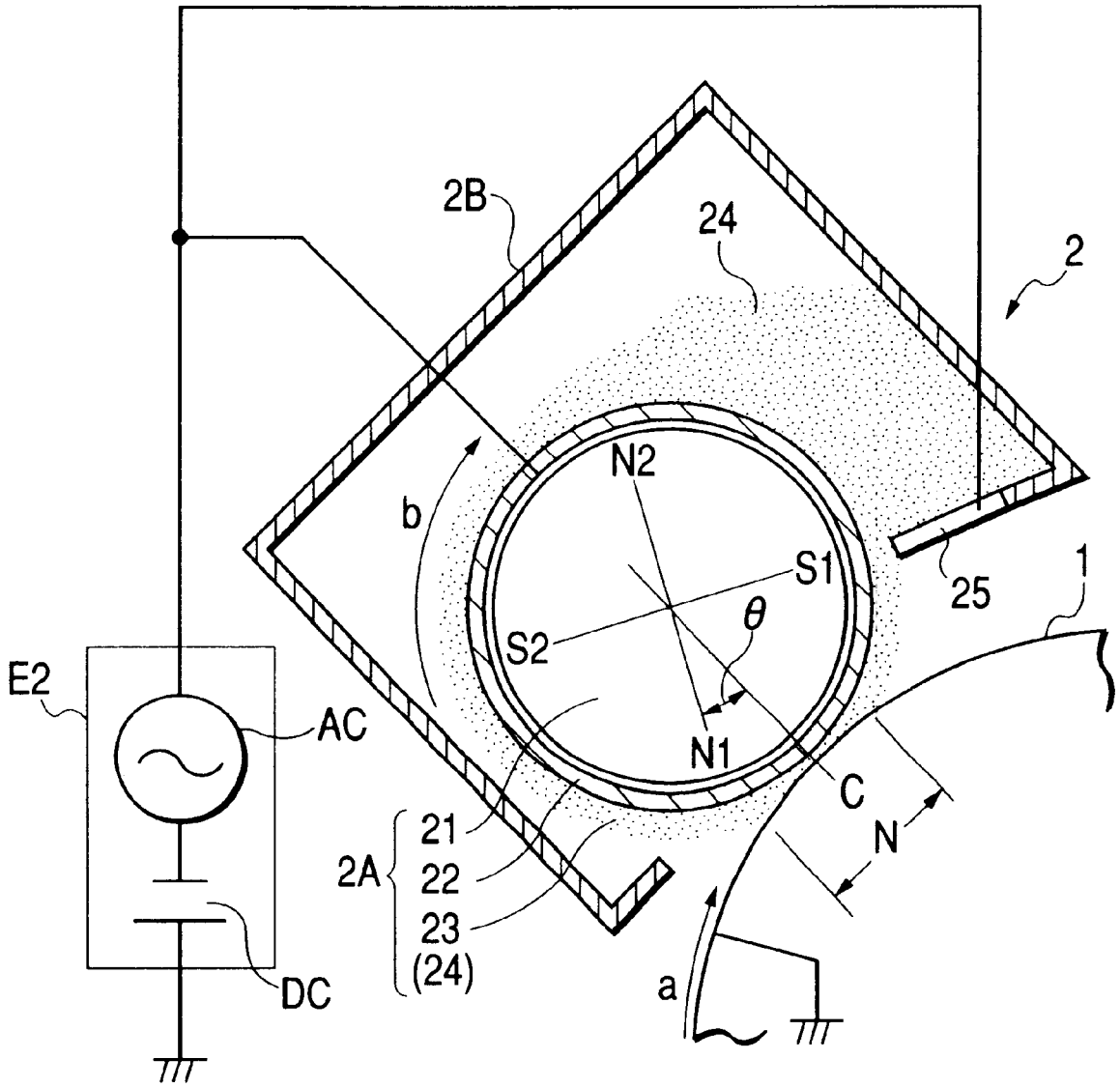
FIG. 9 is an enlarged view showing a magnetic brush charging device in the color image forming apparatus in FIG. 8.

Next, the magnetic brush charging devices 2*a* to 2*d* of this embodiment will be described with reference to FIG. 9. Incidentally, in the following description, subfixes (a to d) of the reference numerals denoting the magnetic brush charging devices of the respective image forming stations Pa to Pd will be omitted.

The magnetic brush charging device 2 of this embodiment is generally divided into and comprises a magnetic brush charging member (magnetic brush charger) 2A, a container (housing) 2B containing conductive magnetic particles (charge carriers) 24 and a bias applying power supply E2 to apply a charging bias to the magnetic brush charger 2A.

The magnetic brush charger 2A of this embodiment is a sleeve rotation type, comprising a magnet roll (magnet) 21, a non-magnetic stainless sleeve (to be referred to as electrode sleeve, conductive sleeve, and charging sleeve, etc.) 22 surrounding this magnet roll 21 and a magnetic brush portion 23 of the magnetic particles 24 which is formed and retained on the outer periphery surface of the sleeve 22 by a magnetic binding force of the magnet roll 21 inside the sleeve.

The magnet roll 21 is a non-rotary stationary member and the sleeve 22 is driven to be rotated at a predetermined peripheral speed, or 225 mm/sec in this embodiment by a drive system (not shown) in the direction indicated by the arrow b around outside this magnet roll 21. In addition, the sleeve 22 is disposed to hold a gap of around 500 μm with means such as spacer roller against the photosensitive drum 1.

To the container 2B, a magnetic brush layer thickness regulating blade 25 made of non-magnetic stainless is attached so as to oppose the sleeve 22, and is disposed so as to constitute a gap of 900 μm against the surface of the sleeve 22.

Some of the magnetic particles 24 in the container 2B undergo magnetic binding with the magnetic force of the magnet roll 21 to be held as a magnetic brush portion 23 onto the outer periphery surface of the sleeve 22. With the rotation of the sleeve 22, the magnetic brush portion 23 rotates together with the sleeve 22 in the same direction as that of the sleeve 22. At this time, the layer thickness of the magnetic brush portion 23 is regulated to a uniform thickness by the blade 25. In addition, since the regulated layer thickness of the magnetic brush portion 23 is larger than the gap of the opposing portion between the photosensitive drum 1 and the sleeve 22, the magnetic brush portion 23 forms a nip portion of a predetermined width to contact the photosensitive drum 1 in the opposing portion where the sleeve 22 and the photosensitive drum 1 are opposed to each other. This contact nip portion is the charging nip portion N. Accordingly, the photosensitive drum 1 is rubbed by the magnetic brush portion 23 rotating in association with rotation of the sleeve 22 of the magnetic brush charger 2A in the charging nip portion N. In this case, in the charging nip portion N, the moving direction of the photosensitive drum 1 will be opposite to the moving direction of the magnetic brush portion 23 and relative movement speed will get fast.

A predetermined charging bias is applied from the power supply E2 to the sleeve 22 and to the magnetic brush layer thickness regulating blade 25. Thus, the photosensitive drum 1 being driven to be rotated, the sleeve 22 of the magnetic brush charger 2A being driven to be rotated, and a predetermined charging bias being applied from the power supply E2, the periphery surface of the photosensitive drum 1 undergoes contact charging processing uniformly with a predetermined polarity and potential with the injection charging system in this embodiment.

The magnet roll 21 disposed stationary inside the sleeve 22 desirably has the angle θ formed by the sleeve 22 with the most closest position C of the photosensitive drum 1 to fall within a range of 20° in the upstream side and 10° in the downstream side of the rotation direction of the photosensitive drum, and more desirably 15° to 0° in the upstream side. If the angle is directed further downstream than that, the magnetic particles are attracted to the main pole position and piling up of the magnetic particles is apt to take place on the downstream side of the charging nip portion N in the rotating direction of the photosensitive drum, and if the angle is directed too upstream, the conveying performance on the magnetic particles having passed the charging nip N gets worse and piling up will be apt to take place. In addition, in the case where there is no electrode in the charging nip portion N, the binding force to the sleeve 22 to be applied to the magnetic particles will get weak and it is obvious that the magnetic particles are apt to be attached onto the photosensitive drum 1. Here, the charging nip portion N described here denotes a region where the magnetic particles of the magnetic brush portion 23 are in contact with the photosensitive drum 1 at the time of charging. In this embodiment, the magnetic pole N1 of approximately 900 G was disposed in the position making the angle θ=10° in the upstream side.

The charging bias by the power supply E2 to be used in this embodiment is the bias by superimposing the AC component on the DC component.

Rubbing operation on the surface of the photosensitive drum 1 with the magnetic brush portion 23 of the magnetic brush charger 2A and application of the charging bias onto the magnetic brush charger 2A both in the charging nip portion N imparts electric charges from the charging magnetic particles 24 configuring the magnetic brush 23 onto the photosensitive drum 1 so that the surface of the photosensitive drum 1 undergoes contact charging uniformly with a predetermined polarity and potential. In this embodiment, the photosensitive drum 1 is provided with a charge injection layer on its surface, and the charge injection charging proceeds with charging processing on the photosensitive drum 1. That is, the surface of the photosensitive drum 1 is charged to a potential corresponding with the DC component of the charging bias DC+AC. As the rotary velocity of the sleeve 22 gets faster, charging uniformity is apt to get well.

Figure 10:
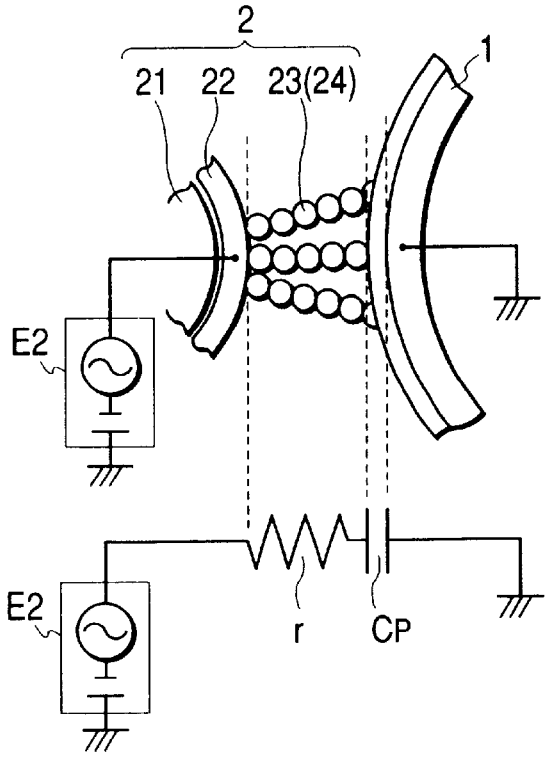
FIG. 10 is an equivalent circuit diagram of the charging circuit in the magnetic brush charging device in FIG. 9.

The charge injection charging of the photosensitive drum 1 with the magnetic brush charger 2A can be regarded as a circuit in series with the resistor R and the capacitor C as shown in the equivalent circuit in FIG. 10. In the case of such a circuit, the surface potential Vd of the photosensitive drum is expressed by the equation (2) with the resistance being r, the electrostatic capacitance being Cp of the photosensitive member, the applied voltage being V0, the charging time (the time for a point on the surface of the photosensitive drum to pass the charging nip portion N) being T0.

$$Vd=V0(1-\exp(T0/(Cp\cdot r))) \quad \text{Equation (2)}$$

In the charging bias DC+AC, the DC component is the same value as the surface potential of the photosensitive drum 1 which is regarded as necessary, or −700 V in this embodiment.

As for the AC component at the time of image formation (at the time of image formation), its peak-to-peak voltage Vpp is preferably not less than 100 V and not more than 2000 V, and in particular not less than 300 V and not more than 1200 V. In the case of the peak-to-peak voltage Vpp being not more than that, the effect of charging uniformity as well as potential's rising edge performance improvement is weak and in the case of not less than that, piling up of the magnetic particles and attachment thereof onto the photosensitive drum get worse. The frequency is preferably not less than 100 Hz and not more than 5000 Hz, in particular, not less than 500 Hz and not more than 2000 Hz. In the case of not more than that, attachment of the magnetic particles onto the photosensitive drum gets worse and the effect of charging uniformity as well as potential's rising edge performance improvement gets weak and also in the case of not less than that, it will become difficult to attain the effect of charging uniformity as well as potential's rising edge performance improvement. As for the waveform of the AC, rectangular waves, triangular waves, and sine waves, etc. will be appropriate. In this embodiment 700 V was used as the peak-to-peak voltage Vpp.

As for the magnetic particles 24 configuring the magnetic brush portion 23, in this embodiment, baked ferromagnetic substance (ferrite) which underwent reducing process was used, but those which was molded into particles by mixing resins and ferromagnetic substance powder or those with conductive carbon, etc. being mixed thereto for resistivity adjustment or those to which surface processing was applied can be used. The magnetic particles 24 of the magnetic brush portion 23 must play both of a role to inject charge well to remain in the trap level on the surface of the photosensitive drum and a role to prevent the charging member as well as the photosensitive member from electricity destruction caused by charging current concentrated into defects such as pin holes being given rise to on the photosensitive drum, etc..

Accordingly, the electric resistivity of the magnetic brush charger 2A is preferably $1\times10^4\Omega$ to $1\times10^9\Omega$, in particular, $1\times10^4\Omega$ to $10^7\Omega$. The electric resistivity of the magnetic brush charger 2A being less than $1\times10^4\Omega$ is apt to cause pin hole leak easily, and when it exceeds $1\times10^9\Omega$, good charge injection become less realizable.

In addition, in order to control the resistivity within the above described range, the volume resistivity of the magnetic particles 24 is desirably $1\times10^4\Omega\cdot$cm to $1\times10^9\Omega\cdot$cm, and is desirably in particular $1\times10^{4}\Omega\cdot$cm to $1\times10^7\Omega\cdot$cm.

The electric resistivity of the magnetic brush charger 2A used in this embodiment is $1\times10^6\Omega\cdot$cm, and −700 V being applied as the DC component of the charging bias made the surface potential of the photosensitive drum 1 become −700 V.

Figure 11:
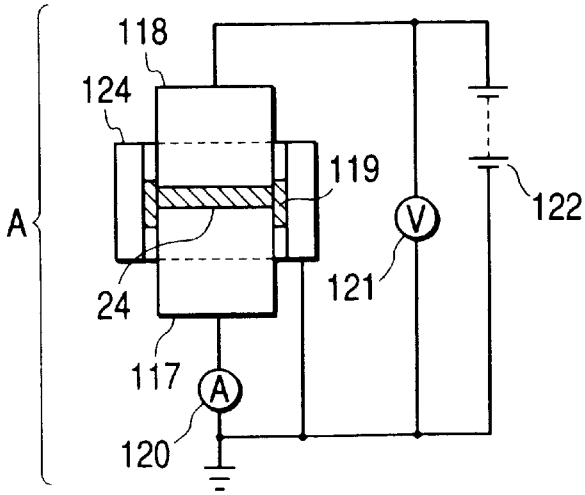
FIG. 11 is a point-explaining view to measure the electric resistance value of magnetic particles in the magnetic brush charging device in FIG. 9.

The volume resistivity of the magnetic particles 24 was measured with arrangements shown in FIG. 11. That is, the cell A was filled with the magnetic particles 24. A main electrode 117 and an upper electrode 118 were disposed so as to be brought into connection with the filling magnetic particles 24, a voltage was applied from a constant voltage power supply 122 to the electrodes 117 and 118, and currents flowing at that time were measured with a current meter 120 so that the volume resistivity was given. Reference numeral 119 denotes insulating substance, reference numeral 121 denotes a voltmeter, and reference numeral 124 denotes a guide link. The measuring conditions thereon are the contact area S=2 $cm^2$ with the cell of the filling magnetic particles 24, thickness d=1 mm, the load of the upper electrode 118 being 10 kgf, and the applied voltage being 100 V under environment of the temperature 23° C. and the humidity 65%.

From a view point of prevention of charging deterioration caused by contamination of the particle surface and prevention of attachment of magnetic particles onto the photosensitive drum 1, it is preferable that the peak in measurement of average particle diameter and particle size distribution on the magnetic particles 24 is within a range of 5 to 100 $\mu$m. The average particle size distribution of the magnetic particles 24 is represented by the maximum chord length in the horizontal direction, and the measuring method is microscopy in which the magnetic particles of not less than 300 units are selected at random and their diameters are actually measured so that the arithmetic mean is taken.

Incidentally, in order to solve such problems that increase in abrasion wear in the surface of the conveying belt caused by cleaning blade 15 increases or occurrences of scratches will take place, thus giving rise to shortage of the life of the conveying belt, as described in the first embodiment, such a method is considered that at a predetermined timing other than at the time of image formation, employed was such a configuration that a solid or half tone belt image having a width covering the entire region of the main scanning direction or a likewise width and of several mm to several tens mm in the sub-scanning direction is formed on the photosensitive drum, undergoes transfer operation in the transfer region, forms an image directly onto the conveying belt 9, and causes the toner forming that belt image to reach the edge portion of the cleaning blade 15 so as to activate the abrasive and lubricant function with this toner. In this method, stabilization on the cleaning function can be attained by the effect to abrade the attached substance on the surface of the conveying belt 9 to hold the state of the surface of the conveying belt 9 constant and the effect to improve the lubricant performance of the edge portion of the cleaning blade 15.

However, in the image forming apparatus comprising a cleanerless system in a plurality of the image forming stations Pa to Pd which are disposed along the moving direction of the transfer belt 9, in the case where a belt image is formed in the image forming stations Pa to Pc, a problem described below has taken place.

In the case where the above described cleanerless system was applied to the color image forming apparatus of tandem type as in this embodiment, the toner image once transferred onto the recording material is transferred again onto the photosensitive drum (hereinafter referred to as "re-transfer") at the time when the next color is transferred, resulting in a problem of unavailability of desired toner images. Considering that all the color image forming apparatuses reproduce respective kinds of colors by superimposing chromatic colors, re-transfer will influence all superimposed chromatic colors over the entire recording material.

For example, as in this embodiment, in the case of combining the above described color image forming apparatus of tandem type and the cleanerless system, the mixture of the transfer residual toner and the re-transfer toner is developed and collected by the fog removal bias Vback. Since the color of the re-transfer toner is different from that of the transfer residual toner, the re-transfer toner is developed and collected together with the transfer residual toner, resulting in color mixture in the developer. Accordingly, as the image formation is proceeded, toners in different colors are accumulated in the developing devices, and therefore desired chromatic color will become unavailable. This phenomenon will become remarkable in particular at the time when the quantity of the re-transfer toner is abundant. This phenomenon was recreated by the following experiment.

(Color mixture experiment)

Figure 12:
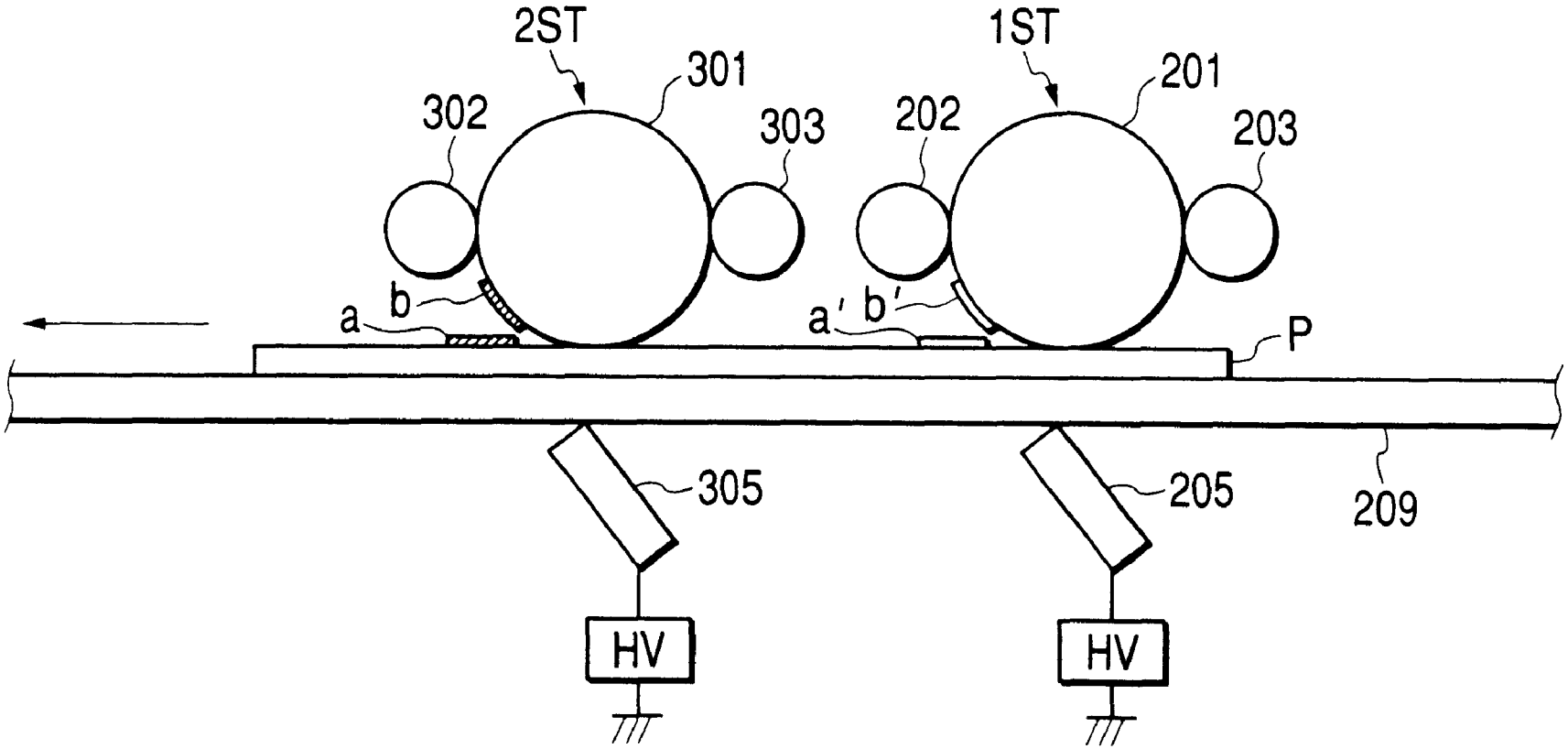
FIG. 12 is a drawing to show an experimental point of re-transfer related to the cleaner-less system.

As shown in FIG. 12, two stations (image forming stations) are prepared with the first station 1ST being a station disposed in the upstream side in the conveying direction of the recording material and with the second station 2ST being a station disposed in the downstream side in the conveying direction, respectively comprising photosensitive drums 201 and 301, developing devices 203 and 303, brush charging devices (magnetic brushes) 202 and 302, and transfer devices 205 and 305, etc. The first and the second stations formed a belt image in cross feed direction (main scanning direction) constituting 6% ratio for a A-4 size sheet respectively.

In the second station 2ST, the re-transfer toner having taken place during an image formation is temporally collected by the magnetic brush 302 of the second station 2ST and polarity was made negative uniformly so as to be vomited to the photosensitive drum 301 thereafter. The vomited re-transfer toner which has reached the developing portion is collected into the developing device 303 by a fog removal bias.

Transfer charging by the transfer devices 205 and 305 was studied with constant current control, but constant voltage control will do as well without giving rise to any problem.

In order to quantify the re-transfer amount, as shown in FIG. 12, the re-transfer rate $\eta rtr$ was defined by $\eta rtr=b/(a+b)\times 100\%$, wherein the toner amount per unit area on the recording material after re-transfer is a g/cm$^2$ and the toner amount per unit area of the re-transferred toner on the photosensitive drum 301 is b g/cm$^2$.

In addition, as for transfer efficiency, likewise the retransfer efficiency $\eta tr$ was given by $\eta tr=a'/(a'+b')\times 100\%$, wherein the toner amount per unit area on the recording material after transfer is a' g/cm$^2$ and the toner amount per unit area of the transfer residual toner having remained on the photosensitive drum 201 is b' g/cm$^2$.

In the present study, the yellow toner was used for the first station 1ST while magenta was used for the second station 2ST, and with the magenta image (belt image in the main scanning direction constituting 6% ratio for a A-4 size sheet) at the time when the study started, that is, under the state that there was no yellow toner in the magenta developing device as the initial, an image similar to the initial was formed every 1000 sheets intermittently at 100 sheets, totaling 10000 sheets to be supplied, and color difference $\Delta E$ between the initial image and the image after 1000 sheets were supplied was measured with the spectral calorimeter SP68 manufactured by X-Rite Co.

Figure 13:
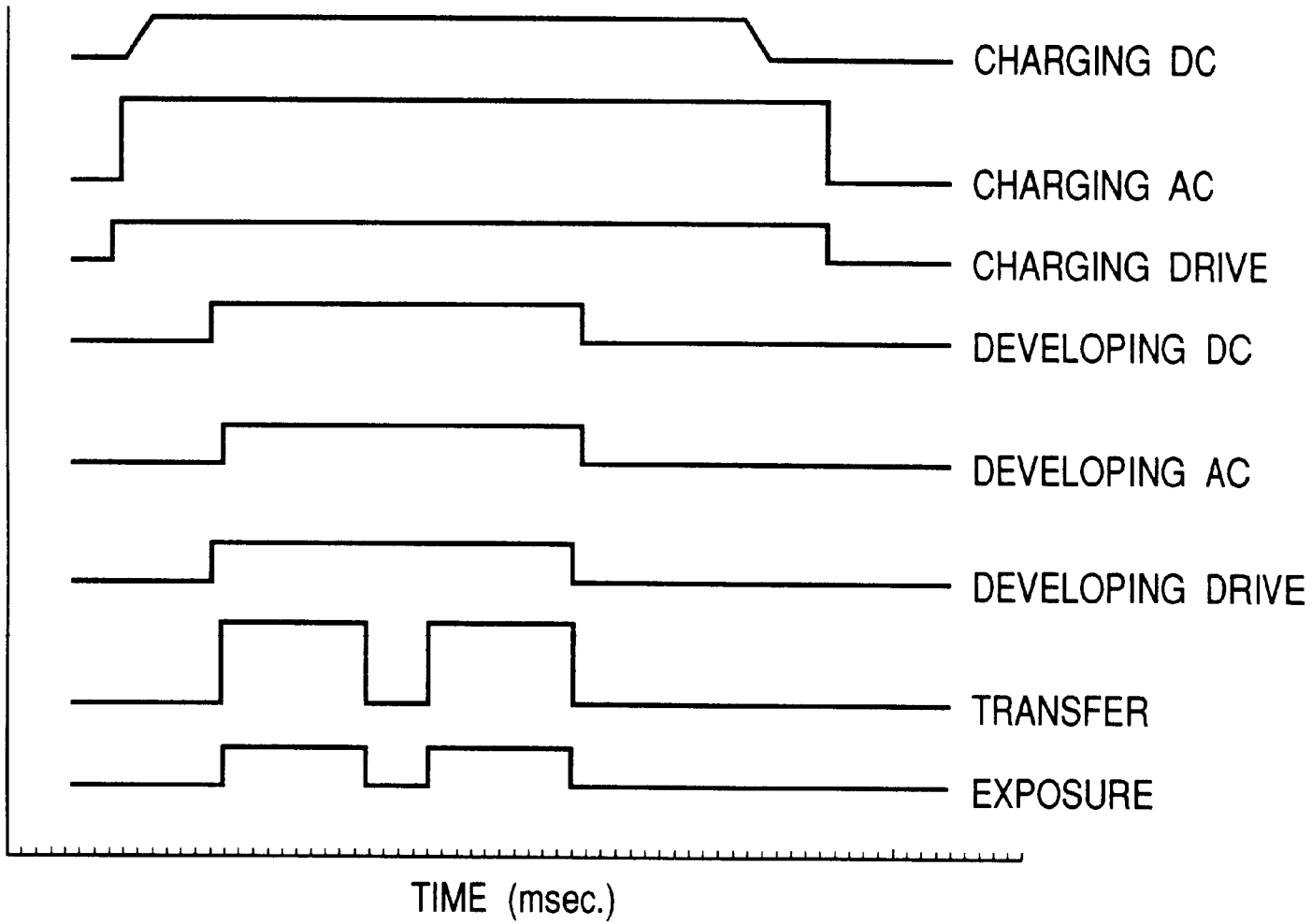
FIG. 13 is a timing chart on image forming in the color image forming apparatus in FIG. 8.

In addition, in the present study, the timing chart (drum standards) shown in FIG. 13 was used.

Incidentally, in the present study, the transfer efficiency $\eta tr$ was 95% and the re-transfer rate $\eta rtr$ was 4% in the second station 2ST.

Figure 14:
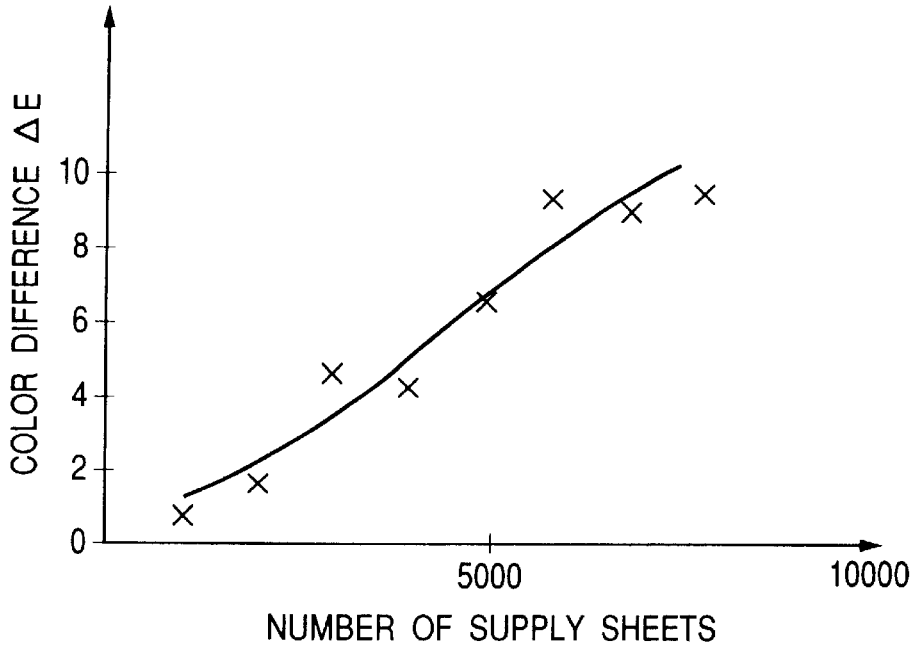
FIG. 14 is a graph showing color difference corresponding with a number of supply sheets.

FIG. 14 shows how color difference changes according to a number of supply sheets. It is obvious that as a number of supply sheets increase, color difference gets larger so as to exceed the upper limit 6.5 being the color difference with which colors are treated as same in terms of impressive level around 5000 sheets having been supplied.

As described so far, it became obvious that the re-transfer toner is mixed into inside the developing device due to the toner recycle system (cleanerless system) by developing causes color difference variation beyond the permissible range.

On the other hand, as described above, also in the case of forming the belt image directly onto the conveying belt in order to solve various problems peculiar to the cleaning device of the blade type, as described above, the toner image once transferred onto the conveying belt 209 undergoes re-transfer when it has reached the subsequent transfer position, consequently causing developer's color mixture, which will cause a problem that desired coloring will become unavailable.

In addition, since, due to influence of re-transfer, the toner amount of the belt image will be reduced at the time when it reaches the cleaning portion, in order to obtain a desired toner amount, exceeding amount of toner must be formed as the belt image in advance, which will be a significant obstacle in terms of running costs.

In order to solve this problem, in each transfer position disposed downstream in the conveying direction of the recording material farther from the station which formed the belt image, the transfer current/voltage was arranged to be lowered at the time when the belt image passed the transfer position, and thereby re-transfer amount could be reduced.

Figure 15:
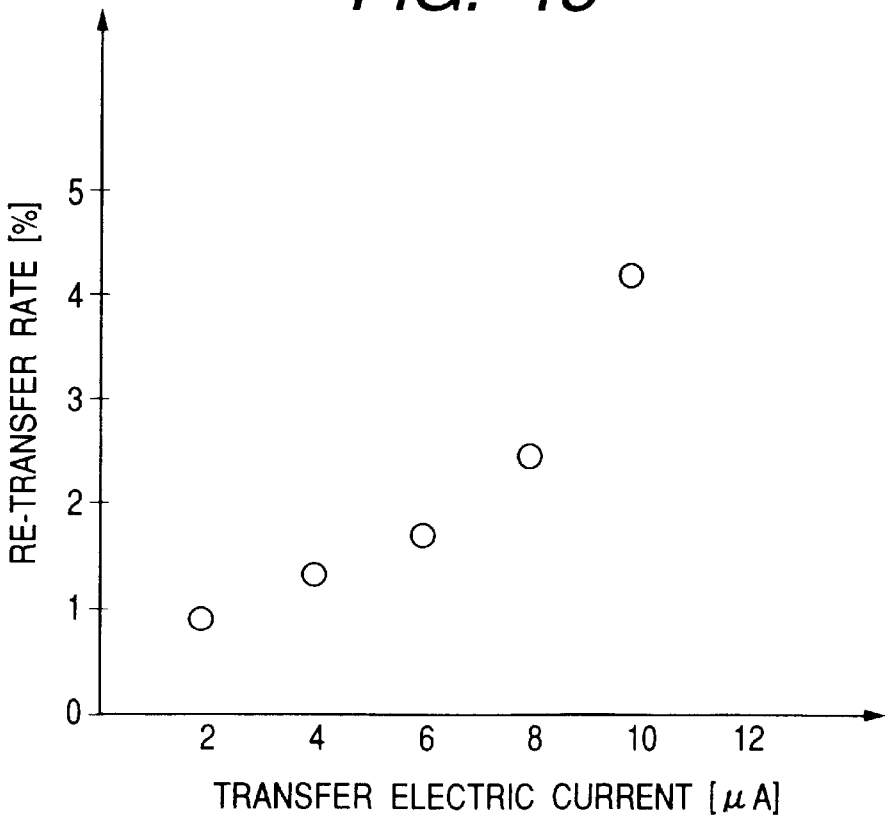
FIG. 15 is a graph showing the relationship between transfer electric current and re-transfer rate.

FIG. 15 shows correlation between the transfer current of the second station 2ST and the re-transfer rate in the second station 2ST in FIG. 12. As shown in FIG. 15, by lowing the transfer current value in constant current control, re-transfer can be reduced.

However, as being obvious from FIG. 15, in spite that the transfer current is 0 $\mu$A, the re-transfer rate cannot be made 0%. This is considered to happen by attaching force and reflection force, etc. between the toner and the photosensitive drum caused by physical contact between the belt image and the photosensitive drum, and is considered to be inevitable in terms of configuration involving physical contact between the toner image and the photosensitive drum.

In order to avoid the above described physical contact between the belt image and the photosensitive drum, a method so as to take a configuration so that the toner image and the photosensitive drum will not be brought into contact with each other when the belt image passes, but therefore various new mechanism will become necessary, giving rise to a significant costly problem.

Moreover, even if such a configuration that will not bring the toner image into physical contact with the photosensitive drum when the belt image passes was taken, such a sequence that the conveying belt and the photosensitive drum are brought into contact with each other when the belt image is transferred onto the conveying belt, and thereafter the conveying belt and the photosensitive drum are made out of contact with each other so as not to bring the toner image into contact with the photosensitive drum must be adopted, giving rise to such an inconvenience that a user will be situated to be left with the image forming apparatus being unavailable for use during that time.

Figure 8:
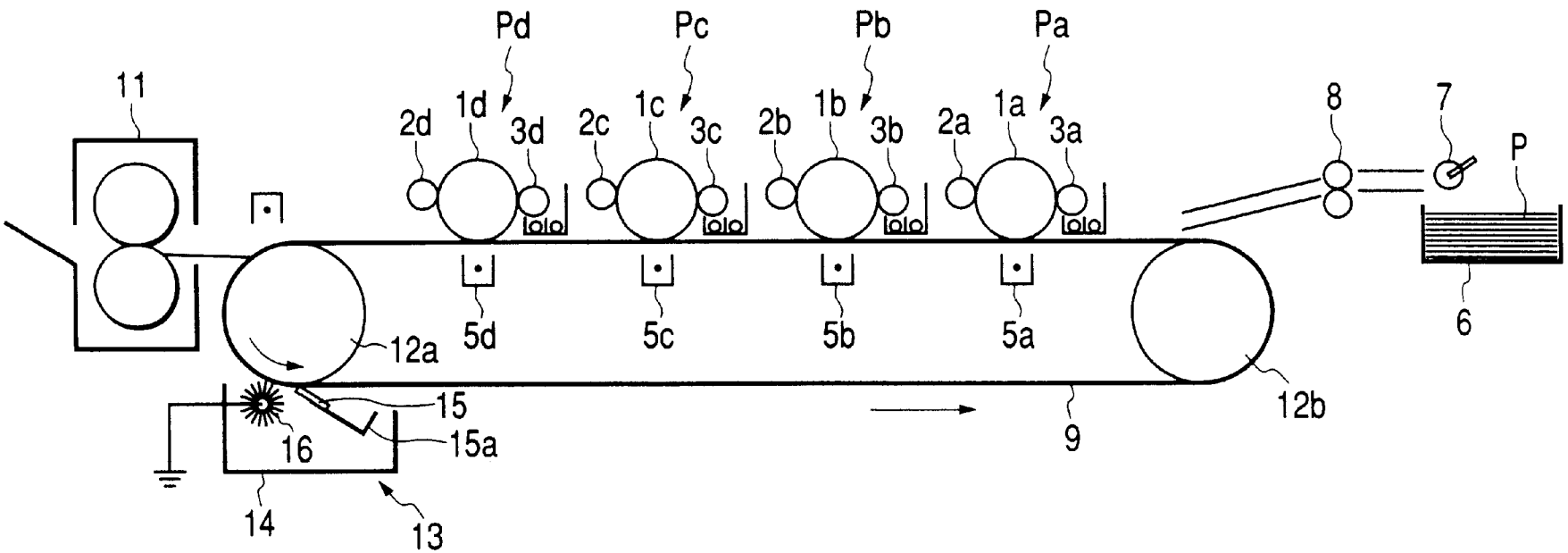
FIG. 8 is a schematic configuration view showing still another embodiment of the color image forming apparatus according to the present invention.

Under the circumstances, in this embodiment, forming the above described belt image in the station disposed downstream-most in the conveying direction of the recording material, that is, in the image forming station Pd in FIG. 8 was able to solve a variety of problems peculiar to the cleaning blade 15 of the above described cleaning device 13, and to prevent occurrence of the above described problems due to re-transfer.

Incidentally, the belt image forming sequence in this embodiment was executed at timings shown below.

1) At the time of the rise of the main power supply of the image forming apparatus 2) at respective timings every image forming of 500 images, a solid belt image in the entire main scanning direction and 10 mm in the sub-scanning direction is formed on the photosensitive drum, and is caused to undergoes transfer operation in the transfer region, forms images directly onto the conveying belt 9, and causes the toner forming that belt image to reach the edge portion of the cleaning blade 15.

An effect to abrade the attached substance on the surface of the conveying belt 9 with the toner to hold the state of the surface of the conveying belt 9 constant and an effect to improve the lubricant performance of the edge portion of the cleaning blade 15 as described above largely depend on titanic acid strontium which was added to toner particles from outside, and otherwise fine powders of such as silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, titanic acid calcium, titanic acid magnesium, tungstic acid phosphorus, molybdenum acid phosphorus, calcium carbonate, magnesium carbonate, and aluminum carbonate, etc. can be nominated, or use of abrasive agent with Mohs' scale of hardness of not less than 6.0 give rise to an effect to abrade and remove the attached substance on the conveying belt surface as well. In addition, in the case where any of them is added from outside, a similar effect appears.

As obvious from FIG. 8, there exists no other color station from the last station Pd to the cleaning portion 13, and therefore naturally re-transfer does not take place. Accordingly, since the respective problems (color mixture in respective developing devices and reduction in the belt image taking place at the time of passing the respective stations) due to re-transfer do not take place, and the belt image is supplied to the cleaning device 13 in a stable fashion, occurrence of respective problems peculiar to the cleaning blade represented by the turning up was reduced.

The region of the belt image and the timing to form the belt image shall not be limited to this embodiment, but from the point of view of running costs, a method involving the direction which can make toner consumption as little as possible, that is, involving less area to form the belt image and few times of forming is desirable. In addition, the length of the belt image in the thrust direction (the direction perpendicular to the moving direction of the transfer belt) is desirably the same as the length in the thrust direction of the abutting portion between the cleaning blade and the transfer belt, or the length close thereto as much as possible within such a range that does not exceed that.

In the study of the present inventors, with the thrust length of the belt image being shorter by not less than 100 mm than the length in the thrust direction of the abutting portion of the above described cleaning blade, the above described blade turning-up has taken place. In addition, even in case of the thrust length of the belt image being not shorter by not less than 100 mm than the thrust length of the abutting portion of the cleaning blade, when the distance between the belt image end and the cleaning blade abutting portion end will exceed 50 mm, the above described blade turning-up has taken place.

As described so far, the belt image has preferably, in concrete, the thrust length being not less than (the thrust width −100 mm) in the cleaning blade abutting portion and not more than the thrust width in the cleaning blade abutting portion. That is, with 1 mm being the thrust length being and L mm being the length in the thrust direction in the cleaning blade abutting portion, the belt image preferably gives $(L-100) \leqq 1 \leqq L$.

In addition, when the belt image actually reaches the edge portion of the cleaning blade 15, the distance between the position of the belt image end and the position of the cleaning blade abutting portion end is desirably not more than 50 mm. That is, the distance between the thrust end of the belt image and the cleaning blade end is desirably not more than 50 mm.

Figure 16:
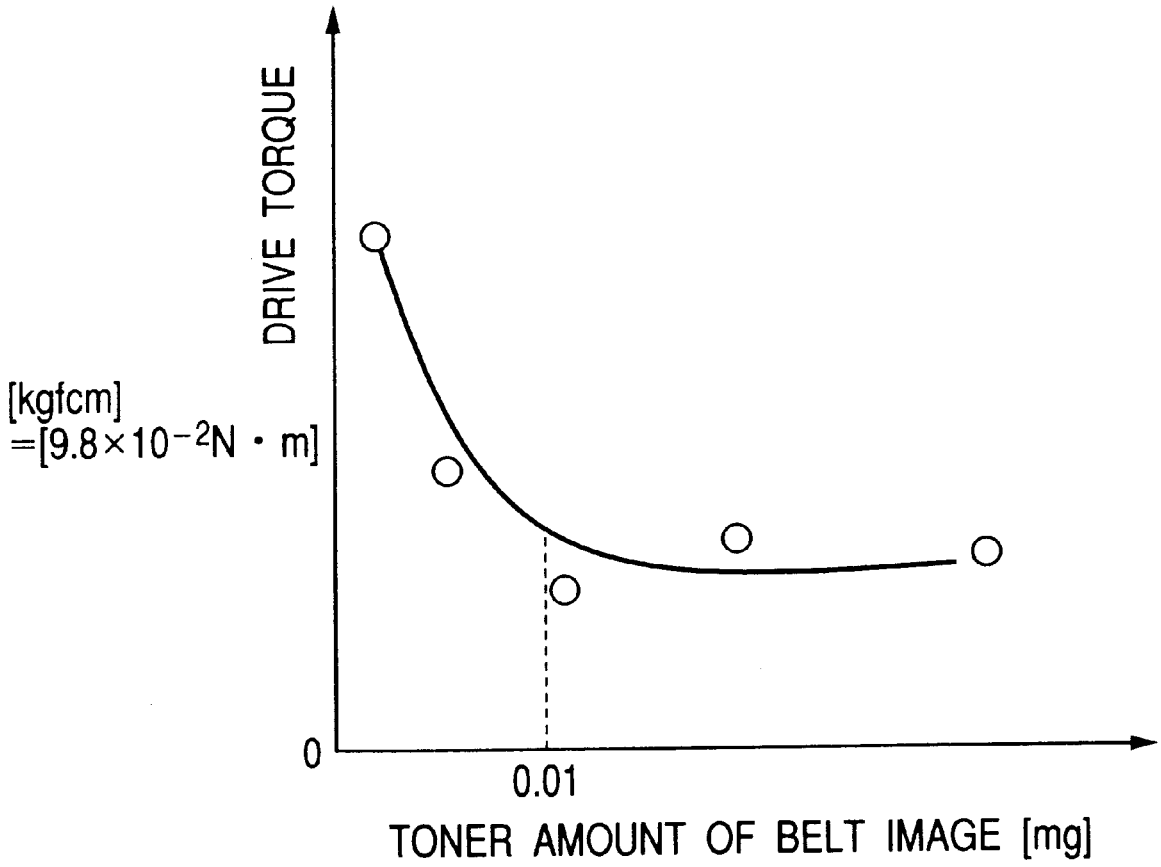
FIG. 16 is a graph showing relationship between toner amount of a belt image and drive torque of the conveying belt.

The graph shown in FIG. 16 expresses the relationship between the drive torque for driving the conveying belt and the toner amount of the belt image. With reference to FIG. 16, with the belt image's toner amount of not less than 0.01 mg, stable drive torque is given, so the belt image's toner amount is desirably not less than 0.01 mg.

In addition, even in the case where the toner amount does not reach 0.01 mg, supplying the toner image to the blade edge in a plurality of installments to give not less than 0.01 mg in total will not give rise to any problem. Moreover, the belt image does not need to be uniform on the thrust, but even in such a mode that a plurality of belt images are grouped, if an effect equivalent to that obtainable by a single belt image, there is no problem.

In addition, in this embodiment, a belt image in parallel along the thrust direction was adopted, but this shall not exclude any that can achieve the operation and effects intended in the present invention.

Embodiment 6

Next, a sixth embodiment of the image forming apparatus related to the present invention will be described with reference to FIG. 17.

The image forming apparatus of this embodiment comprises a cleanerless system as well as the magnetic brush charging device having been described in the above described fifth embodiment and an intermediate transfer belt as an intermediate transfer member.

Incidentally, in the description below, members having the same functions as those for the above described members will be given the same reference numerals and characters, and since the cleanerless system as well as the magnetic brush charging device have been described above in detail, descriptions thereon will be omitted.

The intermediate transfer belt is made of dielectric resin such as polycarbonate, polyethylene terephthalate resin film, polyvinylidene fluoride resin film, polyimide, and ethylene 4 fluorinated ethylene copolymer. In this embodiment, a conductive polyimide seamless belt with the volume resistivity being $1\times10^{9}\Omega\cdot$cm (a probe in conformity with JIS-K6911 method to be used under the applied voltage of 500 V and the applied time of 60 sec) and thickness t=80 $\mu$m was adopted, but other materials, volume resistivity, and thickness may be used.

Figure 17:
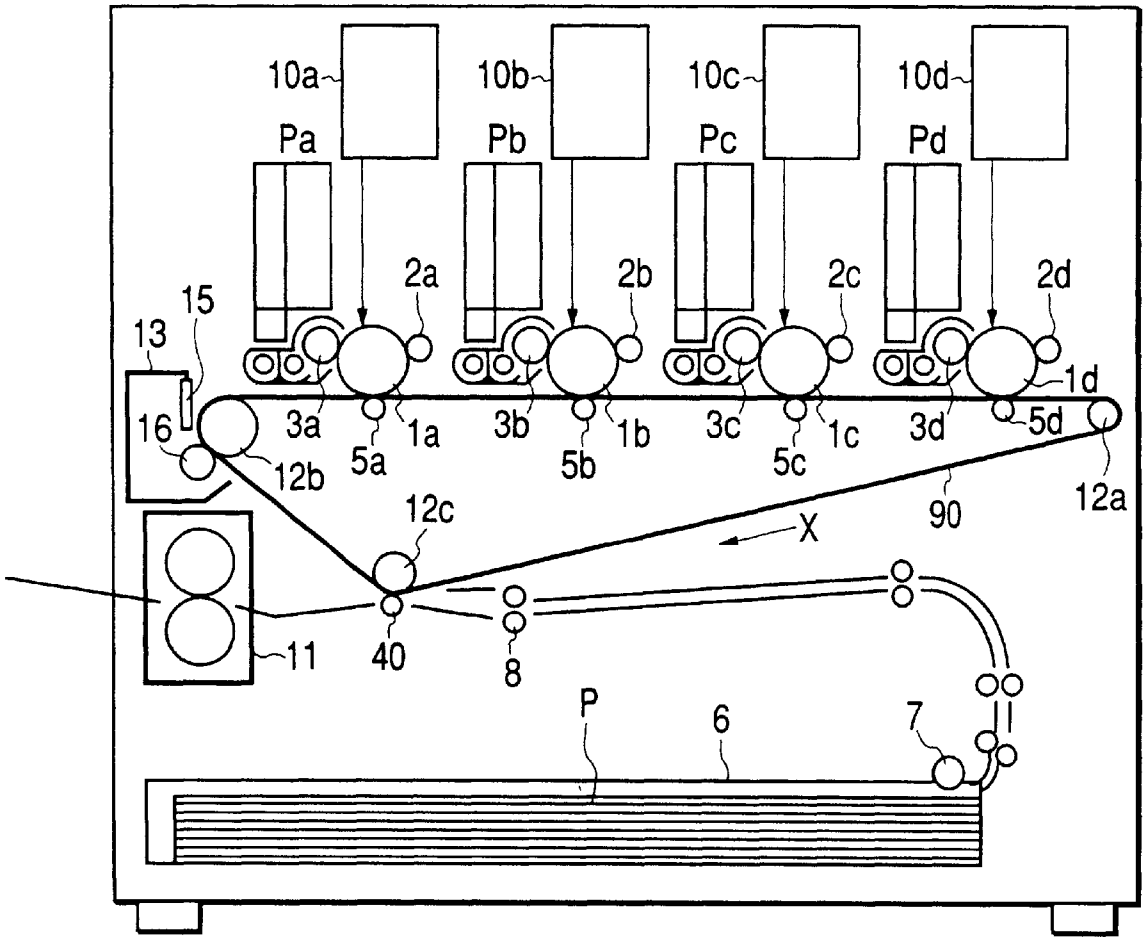
FIG. 17 is a schematic configuration view showing another embodiment of the color image forming apparatus according to the present invention.

As shown in FIG. 17, the intermediate transfer belt 90 is stretched around a drive roller 12*a*, a driven roller 12*b*, and the secondary transfer opposite roller 12*c*, and is driven in the direction indicated by the arrow X.

Above the plane portion of the intermediate transfer belt 90, stations (image forming stations) Pa, Pb, Pc, and Pd, which are configured nearly similarly to those in the above described embodiment, are disposed in series.

The image forming stations Pa to Pd comprise drum-shaped electrophotographic photosensitive members (hereinafter referred to as "photosensitive drum") 1*a*, 1*b*, 1*c* and 1*d* as image bearing members which are supported so as to be capable of rotation respectively. In the periphery of the photosensitive drums 1*a* to 1*d*, process equipment such as the magnetic brush chargers 2*a*, 2*b*, 2*c* and 2*d* and developing devices 3*a*, 3*b*, 3*c* and 3*d* is disposed.

The developing devices 3*a*, 3*b*, 3*c* and 3*d* respectively contain the magenta toner, the cyan toner, the yellow toner and the black toner so that respective image forming stations Pa to Pd form respective color toner images of magenta, cyan, yellow, and black respectively.

The image signals according to magenta component color of the original are inputted to the laser oscillator 10*a* so that the laser beam is projected onto the photosensitive drum 1*a* via a polygon mirror (not shown), etc. to form an electrostatic latent image. The electrostatic latent image is supplied with the magenta toner by the developing device 3*a* for developing and the magenta toner image is formed. When this toner image arrives at the primary transfer position in which the photosensitive drum 1*a* and the intermediate transfer belt 90 are in contact with each other by rotation of the photosensitive drum 1*a,* the toner image is transferred to the intermediate transfer belt 90 by the primary transfer bias applied by the primary transfer device 5*a*.

The intermediate transfer belt 90 bearing the magenta toner image is conveyed to the next image forming station Pb, and no later than this time, in the image forming station Pb, the cyan toner image formed on the photosensitive drum 1*b* in the step similar to that described above is transferred onto the magenta toner image.

Likewise, as the recording material P moves forward to the image forming stations Pc and Pd, the yellow toner image and the black toner image are superimposed sequentially onto the above described toner images in the respective primary transfer positions, and no later than this time, the recording material P taken out by the feed roller 7 from the feed cassette 6 reaches the registration roller 8, and thereafter, the recording material P is further conveyed to the secondary transfer position in synchronism with the toner image, and the above described four (4) color toner image is transferred onto the recording material P by the transfer bias applied to the secondary transfer device 40.

The recording material P is further conveyed to the fixing device 11 so that heat and pressure are applied thereto and the toner image is fixed thereon to become a permanent image.

The residual toner remaining on the intermediate transfer belt 90 after the images are transferred onto the recording material P is collected by the cleaning device 13. As in the fourth embodiment, the cleaning device 13 in this embodiment comprises a cleaning blade 15 made of polyurethane rubber, and its edge is brought into contact with the intermediate transfer belt 90 to scrape off and remove the attached toner.

In addition, the image forming apparatus of this embodiment comprises the above described cleanerless system, and the transfer residual toner having remained on the surface of the photosensitive drums 1*a* to 1*d* without undergoing transfer onto the recording material in the primary transfer position, which reaches the magnetic brush charging devices 2*a* to 2*d* with subsequent rotation of the photosensitive drums 1*a* to 1*d,* is temporally collected in the magnetic brush portion of the magnetic brush charging devices being in contact with the photosensitive drums 1*a* to 1*d,* and the collected toner is again vomited onto the surface of the photosensitive drums 1*a* to 1*d* and is finally collected by the developing devices 3*a* to 3*d* so that the photosensitive drums 1*a* to 1*d* are served for repeating image formation.

As in the fifth embodiment, since this embodiment adopts the cleanerless system, too, the toner image once primarily transferred onto the intermediate transfer belt 90 is re-transferred at the time when the next color is transferred, resulting in color mixture which may cause a problem of unavailability of desired toner images. Accordingly, even if the belt image is formed onto the intermediate transfer belt 90 in order to avoid such a problem of the above described turning up of the cleaning blade, a problem of a change in hue or tone caused by the above described re-transfer and such a problem that re-transfer results in reduction in toner amount itself of the belt image and a desired toner amount is unavailable take place.

Under the circumstances, in this embodiment, forming the above described belt image in the station disposed downstream-most in the moving direction of the intermediate transfer belt, that is, in the fourth station Pd in FIG. 17 was able to solve a variety of problems peculiar to the cleaning blade 15 of the above described cleaning device 13, and to prevent occurrence of the above described problems (color mixture in respective developing devices and reduction in the belt image when passing the respective stations) peculiar to re-transfer.

In this embodiment, the belt image of 310 mm in the main scanning direction and 1 mm in the sub-scanning direction was formed on the intermediate transfer belt 90 every image forming operation. As obvious from FIG. 17, there exists no other color station from the fourth station Pd to the cleaning portion 13, and therefore naturally re-transfer does not take place. Accordingly, since the respective problems peculiar to re-transfer do not take place, and the belt image is supplied to the cleaning device 13 in a stable fashion, occurrence of respective problems peculiar to the cleaning blade represented by turning up was reduced as well.

An effect to abrade the attached substance on the surface of the intermediate transfer belt 90 with the toner to hold the state of the surface of the intermediate transfer belt 90 constant and an effect to improve the lubricant performance of the edge portion of the cleaning blade 15 as described above largely depend on titanic acid strontium which was added to toner particles from outside, and otherwise fine powders of such as silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, titanic acid calcium, titanic acid magnesium, tungstic acid phosphorus, molybdenum acid phosphorus, calcium carbonate, magnesium carbonate, and aluminum carbonate, etc. can be nominated, or use of abrasive agent with Mohs' scale of hardness of not less than 6.0 give rise to an effect to abrade and remove the attached substance on the conveying belt surface as well. In addition, in the case where any of them is added from outside, a similar effect appears.

Incidentally, the region of the belt image and the timing to form the belt image shall not be limited to this embodiment, but from the point of view of running costs, a method involving the direction which can make toner consumption as little as possible, that is, involving less area to form the belt image and few times of forming is desirable.

In addition, in order to supply the cleaning blade 15 with the belt image without shortage, when the belt image passes the secondary transfer position, the secondary transfer charging device 40 is desirably held apart from the intermediate transfer belt 90 or configured so as not to change the absolute amount of the belt toner amount by adjusting the secondary transfer bias.

In addition, using the strain gage 17, which has been described in the above described embodiment 2 or 4, being detecting means to detect deformation of the cleaning blade 15 as a cleaning member, such configuration that the belt image is formed in the case where the output from the strain gage 17 has reached not less than a predetermined value may be used for the above described embodiment 5 or 6. Use of this configuration will make it possible to save running costs since the belt image can be formed only when toner supply becomes necessary for the blade.

Among embodiments having been described so far, the photosensitive drum charging device for attaining the cleanerless system shall not be limited to the magnetic brush charging device, but other, for example, other charging means represented by fur brush charging or roller charging can be used.

Incidentally, also in the above described image forming apparatus of the embodiments 1 and 2, forming the belt image in the image forming station (Pd) in the downstream-most in the moving direction of the conveying belt 9 as the transfer material bearing and conveying means as having been described in the embodiment 5 can solve problems peculiar to the cleaning blade 15 of the cleaning device 13, and attain an excellent effect that reduction in toner amount due to re-transfer of the belt image is prevented so that while limiting useless consumption of toner, cleaning performance can be maintained.

In addition, also in the above described image forming apparatus of the embodiments 3 and 4, forming the belt image in the image forming station (Pd) in the disposed downstream-most in the moving direction of the intermediate transfer belt 90 as the intermediate transfer means as having been described in the embodiment 6 can solve problems peculiar to the cleaning blade 15 of the cleaning device 13, and attain an excellent effect that reduction in toner amount caused by re-transfer of the belt image is prevented so that while limiting useless consumption of toner, cleaning performance can be maintained.

What is claimed is:

1. An image forming apparatus comprising:

a plurality of image bearing members which are disposed along a conveying direction of a transfer material and on which latent images are formed;

developing means which are disposed corresponding to said plurality of image bearing members and develop said latent images with developers, respectively;

transfer material bearing and conveying means to bear and convey the transfer material;

transfer means to sequentially transfer developer images developed on said plurality of image bearing members to the transfer material on said transfer material bearing and conveying means; and a cleaning member which is brought into contact with said transfer material bearing and conveying means and cleans a surface of said transfer material bearing and conveying means, wherein a developer image not to be transferred onto the transfer material is formed only onto an image bearing member disposed downstream in a moving direction of said transfer material bearing and conveying means among said plurality of image bearing members, the developer image is transferred onto said transfer material bearing and conveying means by said transfer means, and said transfer material bearing and conveying means is moved so that the transferred developer image reaches said cleaning member.

2. The image forming apparatus according to claim 1, wherein an image formation onto said image bearing member disposed downstream is executed in an occasion other than a normal image forming operation.

3. The image forming apparatus according to claim 1, wherein when a length of the developer image formed onto said image bearing member disposed downstream is 1 (mm) in a direction perpendicular to the moving direction of said transfer material bearing and conveying means and a length of an abutting portion between said transfer material bearing and conveying means and said cleaning member is L (mm), a condition of:

$$L-100 \leqq 1 \leqq L$$

is fulfilled.

4. The image forming apparatus according to claim 1, wherein a distance between an end of the developer image formed onto said image bearing member disposed downstream in a direction perpendicular to the moving direction of said transfer material bearing and conveying means and an end of an abutting portion between said transfer material bearing and conveying means and said cleaning member is not more than 50 (mm).

5. The image forming apparatus according to claim 1, wherein a weight of the developer image formed onto said image bearing member disposed downstream is not less than 0.01 (mg).

6. The image forming apparatus according to claim 1, wherein a fine powder of titanic acid strontium is added to the developer from outside.

7. The image forming apparatus according to claim 1, wherein a fine powder of Mohs' scale of hardness being not less than 6.0 is added to the developer from outside.

8. The image forming apparatus according to claim 1, comprising detecting means to detect deformation of said cleaning member, wherein in accordance with an outcome of said detecting means, an operation to form the developer image onto said image bearing member disposed downstream is started.

9. An image forming apparatus comprising:

a plurality of image bearing members which are disposed along a moving direction of intermediate transfer means and on which latent images are formed;

developing means which are disposed corresponding to said plurality of image bearing members and develop said latent images with developers, respectively;

primary transfer means to sequentially transfer developer images developed on said plurality of bearing members to said intermediate transfer means;

secondary transfer means to transfer the developer images transferred onto said intermediate transfer means to a transfer material; and a cleaning member which is brought into contact with said intermediate transfer means and cleans a surface of said intermediate transfer means, wherein a developer image not to be transferred onto the transfer material is formed only onto an image bearing member disposed downstream in the moving direction of said intermediate transfer means among said plurality of image bearing members, the developer image is transferred onto said intermediate transfer means by said primary transfer means, and said intermediate transfer means is moved so that the transferred developer image reaches said cleaning member.

10. The image forming apparatus according to claim 9, wherein an image formation onto said image bearing member disposed downstream is executed in an occasion other than a normal image forming operation.

11. The image forming apparatus according to claim 9, wherein when a length of the developer image formed onto said image bearing member disposed downstream is 1 (mm) in a direction perpendicular to the moving direction of said intermediate transfer means and a length of an abutting portion between said intermediate transfer means and said cleaning member is L (mm), a condition of:

$$L-100 \leqq 1 \leqq L$$

is fulfilled.

12. The image forming apparatus according to claim 9, wherein a distance between an end of the developer image formed onto said image bearing member disposed downstream in a direction perpendicular to the moving direction of said intermediate transfer means and an end of an abutting portion between said intermediate transfer means and said cleaning member is not more than 50 (mm).

13. The image forming apparatus according to claim 9, wherein a weight of the developer image formed onto said image bearing member disposed downstream is not less than 0.01 (mg).

14. The image forming apparatus according to claim 9, wherein a fine powder of titanic acid strontium is added to the developer from outside.

15. The image forming apparatus according to claim 9, wherein a fine powder of Mohs' scale of hardness being not less than 6.0 is added to the developer from outside.

16. The image forming apparatus according to claim 9, comprising detecting means to detect deformation of said cleaning member, wherein in accordance with an outcome of said detecting means, an operation to form the developer image onto said image bearing member disposed downstream is started.

17. An image forming apparatus comprising:

a plurality of image bearing members which are disposed along a conveying direction of a transfer material and on which latent images are formed;

charging means which are disposed corresponding to said plurality of image bearing members and charge said plurality of image bearing members, respectively;

developing means which are disposed corresponding to said plurality of image bearing members and develop said latent images with developers, respectively;

transfer material bearing and conveying means to bear and convey the transfer material;

transfer means to sequentially transfer developer images developed on said plurality of image bearing members to the transfer material on said transfer material bearing and conveying means; and a cleaning member which is brought into contact with said transfer material bearing and conveying means and cleans a surface of said transfer material bearing and conveying means, wherein said developing means collect transfer residual developers on said plurality of image bearing members which have remained after the developer images are transferred from said plurality of image bearing members to the transfer material, a developer image not to be transferred onto the transfer material is formed only onto an image bearing members disposed downstream in a moving direction of said transfer material bearing and conveying means among said plurality of image bearing members, the developer image is transferred onto said transfer material bearing and conveying means by said transfer means, and said transfer material bearing and conveying means is moved so that the transferred developer image reaches said cleaning member.

18. The image forming apparatus according to claim 17, wherein an image formation onto said image bearing member disposed downstream is executed in an occasion other than a normal image forming operation.

19. The image forming apparatus according to claim 17, wherein when a length of the developer image formed onto said image bearing member disposed downstream is 1 (mm) in a direction perpendicular to the moving direction of said transfer material bearing and conveying means and a length of an abutting portion between said transfer material bearing and conveying means and said cleaning member is L (mm), a condition of:

$$L-100 \leqq 1 \leqq L$$

is fulfilled.

20. The image forming apparatus according to claim 17, wherein a distance between an end of the developer image formed onto said image bearing member disposed downstream in a direction perpendicular to the moving direction of said transfer material bearing and conveying means and an end of an abutting portion between said transfer material bearing and conveying means and said cleaning member is not more than 50 (mm).

21. The image forming apparatus according to claim 17, wherein a weight of the developer image formed onto said image bearing member disposed downstream is not less than 0.01 (mg).

22. The image forming apparatus according to claim 17, wherein a fine powder of titanic acid strontium is added to the developer from outside.

23. The image forming apparatus according to claim 17, wherein a fine powder of Mohs' scale of hardness being not less than 6.0 is added to the developer from outside.

24. The image forming apparatus according to claim 17, comprising detecting means to detect deformation of said cleaning member, wherein in accordance with an outcome of said detecting means, an operation to form the developer image onto said image bearing member disposed downstream is started.

25. An image forming apparatus comprising:

a plurality of image bearing members which are disposed along a moving direction of intermediate transfer means and on which latent images are formed;

charging means which are disposed corresponding to said plurality of image bearing members and charge said plurality of image bearing members, respectively;

developing means which are disposed corresponding to said plurality of image bearing members and develop said latent images with developers, respectively;

primary transfer means to sequentially transfer developer images developed on said plurality of image bearing members to said intermediate transfer means;

secondary transfer means to transfer the developer images transferred onto said intermediate transfer means to a transfer material; and a cleaning member which is brought into contact with said intermediate transfer means and cleans a surface of said intermediate transfer means, wherein said developing means collect transfer residual developer on said plurality of image bearing members which have remained after the developer images are transferred from said plurality of image bearing members to said intermediate transfer means, a developer image not to be transferred onto the transfer material is formed only onto an image bearing member disposed downstream in the moving direction of said intermediate transfer means among said plurality of image bearing members, the developer image is transferred onto said intermediate transfer means by said primary transfer means, and said intermediate transfer means is moved so that the transferred developer image reaches said cleaning member.

26. The image forming apparatus according to claim 25, wherein an image formation onto said image bearing member disposed downstream is executed in an occasion other than a normal image forming operation.

27. The image forming apparatus according to claim 25, wherein when a length of the developer image formed onto said image bearing member disposed downstream is 1 (mm) in a direction perpendicular to the moving direction of said intermediate transfer means and a length of an abutting portion between said intermediate transfer means and said cleaning member is L (mm), a condition of:

$$L-100 \leqq 1 \leqq L$$

is fulfilled.

28. The image forming apparatus according to claim 25, wherein a distance between an end of the developer image formed onto said image bearing member disposed downstream in a direction perpendicular to the moving direction of said intermediate transfer means and an end of an abutting portion between said intermediate transfer means and said cleaning member is not more than 50 (mm).

29. The image forming apparatus according to claim 25, wherein a weight of the developer image formed onto said image bearing member disposed downstream is not less than 0.01 (mg).

30. The image forming apparatus according to claim 25, wherein a fine powder of titanic acid strontium is added to said developer from outside.

31. The image forming apparatus according to claim 25, wherein a fine powder of Mohs' scale of hardness being not less than 6.0 is added to the developer from outside.

32. The image forming apparatus according to claim 25, comprising detecting means to detect deformation of said cleaning member, wherein in accordance with an outcome of said detecting means, an operation to form the developer image onto said image bearing member disposed downstream is started.

* * * * *

UNITED STATES PATENT AND TRADEMARK OFFICE

CERTIFICATE OF CORRECTION

PATENT NO. : 6,507,724 B2
DATED : January 14, 2003
INVENTOR(S) : Satoshi Tamura and Yuji Bessho It is certified that error appears in the above-identified patent and that said Letters Patent is hereby corrected as shown below:

Title page,
Item [75], Inventors, "Satoshi Tamura, Tokyo (JP);" should read
-- Satoshi Tamura, Mishima (JP); --.

Column 1,
Line 18, "forma" should read -- form a --.
Line 60, "amplitude>a" should read -- amplitude > a --.
Line 61, "frequency<a" should read -- frequency < a --.

Column 2,
Line 34, "long term" should read -- long-term --.
Line 40, "above described" should read -- above-described --.

Column 3,
Lines 3 and 9, "above described" should read -- above-described --.
Line 5, "maintain" should read -- maintains --.
Line 15, "develope" should read -- develop --.
Line 39, "above" should read -- above- --.

Column 4,
Line 1, "above described" should read -- above-described --.

Column 7,
Line 28, "amplitude>a" should read -- amplitude > a --.
Line 29, "frequency<a" should read -- frequency < a --.
Line 55, "undergoes" should read -- undergo --.

Column 9,
Lines 52 and 63, "above described" should read -- above-described --.

Column 10,
Lines 25 and 33, "above described" should read -- above-described --.
Line 47, "having" should read -- has --.

Column 11,
Line 2, "undergoes" should read -- undergo --.

Column 15,
Line 2, "(at the time of image formation)" should be deleted.

UNITED STATES PATENT AND TRADEMARK OFFICE

CERTIFICATE OF CORRECTION

PATENT NO. : 6,507,724 B2
DATED : January 14, 2003
INVENTOR(S) : Satoshi Tamura and Yuji Bessho It is certified that error appears in the above-identified patent and that said Letters Patent is hereby corrected as shown below:

Column 16,
Lines 42 and 54, "above described" should read -- above-described --.

Column 17,
Line 61, "into" should be deleted.
Line 62, "by" should read -- by which --.

Column 18,
Line 21, "lowing" should read -- lowering --.
Lines 32, 52, 56 and 57, "above described" should read -- above-described --.
Line 66, "undergoes" should read -- undergo --.

Column 19,
Line 47, "above described" should read -- above-described -- (both occurrences).
Line 53, "above described" should read -- above-described --.

Column 20,
Line 26, "above" should read -- above- --.
Lines 30 and 51, "above described" should read -- above-described --.

Column 21,
Lines 20, 26, 42, 62 and 64, "above described" should read -- above-described --.

Column 22,
Lines 2, 6, 7, 53 and 58, "above described" should read -- above-described --.
Line 13, "As" should read -- As is --.

UNITED STATES PATENT AND TRADEMARK OFFICE

CERTIFICATE OF CORRECTION

PATENT NO. : 6,507,724 B2
DATED : January 14, 2003
INVENTOR(S) : Satoshi Tamura and Yuji Bessho It is certified that error appears in the above-identified patent and that said Letters Patent is hereby corrected as shown below:

Column 23,
Lines 1 and 12, "above described" should read -- above-described --.

Signed and Sealed this

Ninth Day of September, 2003

JAMES E. ROGAN
*Director of the United States Patent and Trademark Office*